US010196862B2

(12) United States Patent
Li-Leger et al.

(10) Patent No.: US 10,196,862 B2
(45) Date of Patent: Feb. 5, 2019

(54) METHODS AND APPARATUS FOR OPERATIVELY MOUNTING ACTUATORS TO PIPE

(71) Applicant: Cold Bore Technology Inc., New Westminster (CA)

(72) Inventors: Noah Li-Leger, Surrey (CA); Peter Rizun, White Rock (CA); Nicolai Calin Pacurari, Sherwood Park (CA); Craig Anthony Bergmann, Edmonton (CA); Aryan Saed, Maple Ridge (CA)

(73) Assignee: Cold Bore Technology Inc., Calgary (CA)

( * ) Notice: Subject to any disclaimer, the term of this patent is extended or adjusted under 35 U.S.C. 154(b) by 262 days.

(21) Appl. No.: 15/024,834

(22) PCT Filed: Aug. 22, 2014

(86) PCT No.: PCT/CA2014/050812

§ 371 (c)(1),
(2) Date: Mar. 24, 2016

(87) PCT Pub. No.: WO2015/042698

PCT Pub. Date: Apr. 2, 2015

(65) Prior Publication Data

US 2016/0237759 A1 Aug. 18, 2016

Related U.S. Application Data

(60) Provisional application No. 61/982,863, filed on Apr. 22, 2014, provisional application No. 61/883,864, filed on Sep. 27, 2013.

(51) Int. Cl.
*E21B 17/02* (2006.01)
*E21B 47/16* (2006.01)
(Continued)

(52) U.S. Cl.
CPC ..... *E21B 17/02* (2013.01); *E21B 47/01* (2013.01); *E21B 47/16* (2013.01); *G10K 11/004* (2013.01)

(58) Field of Classification Search
CPC ..... E21B 47/16; E21B 17/02; E21B 47/01; E21B 47/022; E21B 47/18; E21B 7/068; G01V 1/40
See application file for complete search history.

(56) References Cited

U.S. PATENT DOCUMENTS 3,103,643 A 9/1963 Kalbfell
4,302,826 A 11/1981 Kent et al.
(Continued)

FOREIGN PATENT DOCUMENTS

EP 1887182 A1 2/2008
WO 9202054 2/1992
WO 2011016810 A1 2/2011

OTHER PUBLICATIONS

DynaLink Telemetry System, see: http://www.halliburton.com/en-US/ps/testing-subsea/reservoir-testing-analysis/data-acquisition/dynalink.page?node-id=hhiycvxi, 2016.

*Primary Examiner* — Daniel P Stephenson
(74) *Attorney, Agent, or Firm* — Oyen Wiggs Green & Mutala LLP

(57) ABSTRACT

An apparatus for mounting one or more transducers to a drill pipe. The apparatus comprises a sub-pipe having a bore and a transducer-holding assembly, wherein the transducer-holding assembly is insertable into the bore of the sub-pipe from an axial end of the sub-pipe. The apparatus further comprising a tension collar connected to the bore-defining surface of the sub-pipe and bearing upon the transducer-holder.

22 Claims, 20 Drawing Sheets

(51) Int. Cl.
*G10K 11/00* (2006.01)
*E21B 47/01* (2012.01)

(56) References Cited

U.S. PATENT DOCUMENTS 5,222,049 A 6/1993 Drumheller
5,467,832 A 11/1995 Orban et al.
5,703,836 A 12/1997 Drumheller
6,272,916 B1 8/2001 Taniguchi et al.
6,347,674 B1 * 2/2002 Bloom ..... E21B 4/18 175/104
6,442,105 B1 8/2002 Tubel et al.
6,499,545 B1 * 12/2002 MacGugan ..... E21B 47/024 166/66
6,581,699 B1 * 6/2003 Chen ..... E21B 7/067 175/61
6,705,415 B1 * 3/2004 Falvey ..... E21B 7/04 175/304
6,956,791 B2 10/2005 Dopf et al.
7,032,930 B2 * 4/2006 Sutherland ..... E21B 17/003 175/320
7,477,162 B2 * 1/2009 Clark ..... E21B 47/01 166/248
8,022,840 B2 9/2011 Camwell et al.
8,157,025 B2 * 4/2012 Johnson ..... E21B 7/067 175/101
8,258,976 B2 * 9/2012 Price ..... E21B 17/028 166/380
2002/0159336 A1 10/2002 Brown et al.
2006/0002232 A1 1/2006 Shah et al.
2009/0129203 A1 5/2009 Jones et al.
2012/0062235 A1 3/2012 Khan et al.
2015/0285067 A1 * 10/2015 Logan ..... E21B 47/187 175/317
2015/0354351 A1 * 12/2015 Morrow ..... E21B 47/01 367/82
2016/0138391 A1 * 5/2016 Logan ..... E21B 4/14 367/85
2016/0237759 A1 * 8/2016 Li-Leger ..... E21B 47/01
2018/0066510 A1 * 3/2018 Walker ..... E21B 47/011

* cited by examiner

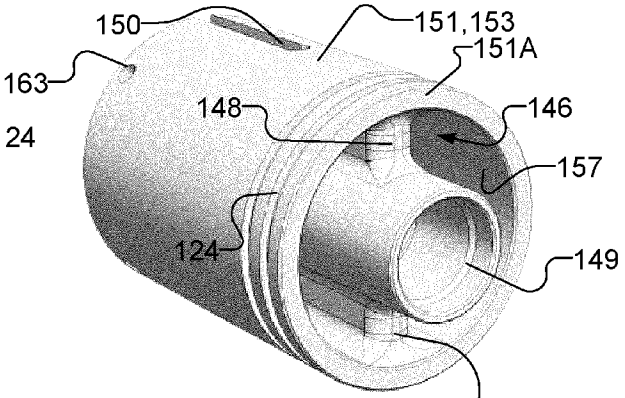
Figure 12B
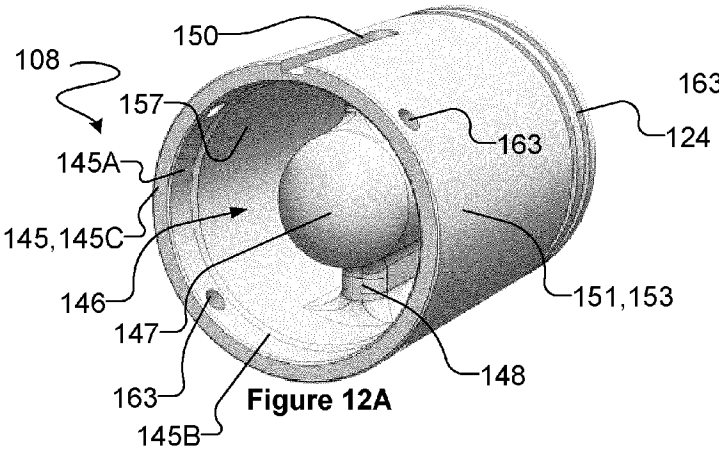
Figure 12A
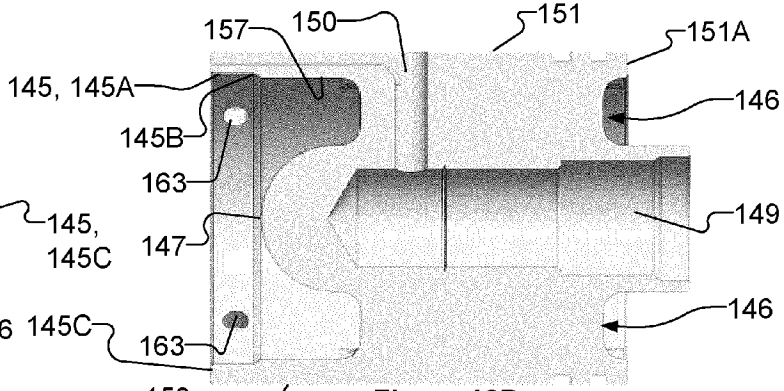
Figure 12D
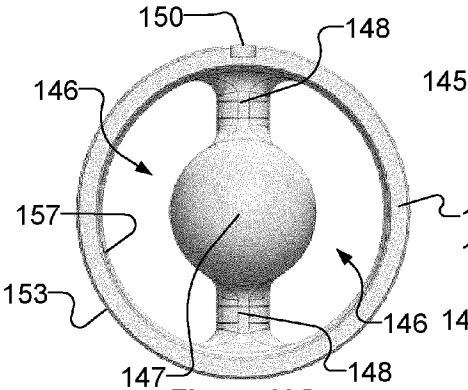
Figure 12C
Figure 12

TRANSMISSION CONFIGURATION
ALTERNATING POLARITY WITH PARALLEL WIRING

RECEIVE CONFIGURATION
ALIGNED POLARITY WITH SERIES WIRING

METHODS AND APPARATUS FOR OPERATIVELY MOUNTING ACTUATORS TO PIPE

CROSS REFERENCE TO RELATED PATENT APPLICATIONS

This international application claims priority to U.S. Application 61/883,864, filed, Sep. 27, 2013, and U.S. Application 61/982,863, filed, Apr. 22, 2014, both of which are hereby incorporated herein by reference in their entirety.

TECHNICAL FIELD

The invention relates to drilling using drill strings comprising pipe. Particular embodiments provide methods and apparatus for operatively mounting one or more transducers to such pipes for effecting acoustic communication through the drill string.

BACKGROUND

Wells of the type commonly used for fossil fuel exploration, water well drilling, geothermal energy applications and/or the like are often several kilometers deep. Typically, these wells or "boreholes" are drilled using drilling pipes (typically referred to as "drill strings") assembled from sections (typically referred to as "pipe stands") connected end-to-end by suitable connection joints. Pipe stands may be about 30 to 45 feet long (about 9 m to 14 m). To form a borehole, the drill string is rotated such that a drill bit attached to its "downhole" (or operative) end bites into the earth. Additional pipe stands are typically added to the "uphole" (or surface) end of the drill string as the borehole deepens.

Drilling fluid, often referred to as "drilling mud" is typically pumped through an axial bore in the drill string from the surface to the downhole end of the drill string. The drilling mud typically exits the drill string at the downhole end and returns to the surface through the space between the drill string and the borehole. The drilling mud may cool and lubricate the drill bit, power the drill bit (e.g. through hydrodynamic pressure), provide a deposit on the borehole wall to seal the formation, and remove debris from the borehole.

There is a general desire to communicate information from a downhole location at or near the end of the drill string (e.g. near the drill bit) to an uphole location (e.g. a surface location at or near the opening of the borehole). Such communication may permit monitoring of one or more sensors at the downhole location and may also permit control of the drilling operation (e.g. steering, drilling fluid pump parameters, rotational speed and/or the like) based on feedback received from such sensors. Such sensors which are referred to as measurement while drilling (MWD) sensors may sense characteristics of the drill string, the drill bit and/or the borehole. Examples of MWD sensor information may include temperature information, pressure information, incline orientation information, azimuthal orientation information, vibration information, drilling torque information and/or the like. In addition to sensor information, it may be desirable to communicate management information from the downhole location to the uphole location. By way of example, such management information may include information related to the sensor information (e.g. the amount sensor data, the type of sensor data, the transmission order of sensor data and/or the like).

One technique which has been proposed for communicating MWD information from a transmitter at a downhole location to a receiver at an uphole location involves acoustic telemetry through the drill string. These techniques comprise communicating via acoustic (or pressure) waves that travel through the drill string (e.g. through the pipe body). There is a general desire to generate, control, receive and/or otherwise create and make use of acoustic waves which may travel within and along such pipes. By way of non-limiting example, such waves can be used to communicate data along drill strings.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides an apparatus for mounting transducers to a drilling pipe for acoustic communication along the pipe. The apparatus comprises a sub-pipe having a bore and connectors on each axial end. The connectors allow the sub-pipe to be connected to the drilling pipe. The apparatus also has a transducer-holding assembly holding one or more transducers. The transducer-holding assembly is insertable into the bore of the sub-pipe from the axial ends of the sub-pipe. In some embodiments, the transducer-holding assembly is mounted within the sub-pipe after it has been inserted into the bore. In some embodiments, the sub-pipe is monolithically fabricated.

In some embodiments, a bore defining surface of the sub-pipe comprises an arrest. The arrest is shaped to reduce a cross-sectional area of the bore relative to the rest of the bore. In some embodiments, the non-reduced cross-sectional area of the bore extends from the arrest to a first axial end of the sub-pipe and the reduced cross-sectional area of the bore extends from the arrest to a second axial end of the sub-pipe. The transducer-holding assembly is then operably insertable into the bore from the first axial end of the sub-pipe. In some embodiments, the arrest may be a lipped or threaded arrest.

In some embodiments, the transducer-holding assembly will be mounted to the sub-pipe using a tension collar. The tension collar bears against the transducer-holding assembly. In some embodiments, the tension collar is connected to the bore-defining surface of the sub-pipe and is axially moveable relative to the sub-pipe. In some embodiments, the tension collar is threadably connected to the bore-defining surface of the sub-pipe.

In some embodiments, the apparatus comprises a feed-through insertable into the bore of the sub-pipe between the transducer-holding assembly and the arrest. In some embodiments, the feed-through comprises a sub-pipe engaging portion, a connector portion, and one or more arms which extend between the sub-pipe portion and the connector portion. In some embodiments, the feed-through comprises one or more conduits for routing electrical connections to the transducers. Such conduits may run through the arms.

Another aspect of the invention provides a transducer-holding assembly. The transducer-holding assembly comprises a transducer holder and one or more preloaded transducer assemblies comprising one or more transducers. The transducer holder comprises one or more mounting features to mount the one or more preloaded transducer assemblies.

In some embodiments, the one or more mounting features of the transducer holder comprises a first and second flange spaced apart such that a transducer assembly may be inserted and mounted between the first and second flange. In some embodiments, the first and second flanges extend in generally radial directions.

In some embodiments, the one or more mounting features of the transducer holder may also comprise an axially extending flange protrusion on the first and/or second flange surface. In this embodiment, the transducer assembly comprises a complementary axially recessed slot for receiving the flange protrusion. The protrusion and slot may help hold the transducer assembly between the first and second flanges and may prevent the transducer assembly from rotating. In some embodiments, the location of the protrusion and the slot may be reversed, i.e. the protrusion may be located on the transducer assembly and the slot may be on the first and/or second flange. In some embodiments, the recessed slot and/or protrusion may extend to the radially outward edge of the first and/or second flange.

Another aspect of the invention provides a transducer assembly. The transducer assembly comprises a plurality of transducers and a pair of threaded members. The plurality of transducers is generally axially aligned. The pair of thread members is threadably adjustable to move axially relative to one another and also generally axially aligned with the plurality of transducers. Accordingly, in some embodiments, adjustment of the relative axial positions of the pair of threaded members adjusts a corresponding axial length of the transducer assembly.

In some embodiments, the transducer assembly is held by the transducer holder through contact between the transducer assembly's first and second axial ends and the first and second flange surfaces of the transducer holder. Adjustment of the relative axial positions of the pair of threaded members causes a corresponding adjustment of compression force applied to the plurality of transducers between the first and second flange surfaces.

In some embodiments, the transducer assembly comprises a cap and rod. The cap is located on one axial end of the transducer assembly while the pair of threaded member is located on the opposing axial end. The plurality of transducers is apertured and the rod extends through the aperture between the cap and one of the pair of threaded members.

Another aspect of the invention provides an apparatus for mounting one or more transducers to a drilling pipe comprising: a sub-pipe comprising a bore-defining surface defining an axially oriented bore therethrough, a connector at a first axial end, and a connector at a second axial end, at least one of the connectors connectable to the drilling pipe; and a transducer-holding assembly comprising one or more transducers, the transducer-holding assembly operably insertable into the bore of the sub-pipe from one of the first and second axial ends and mountable in the bore of the sub-pipe to provide intimate contact which facilitates acoustic communication between the one or more transducers and the sub-pipe.

Another aspect of the invention provides method for mounting one or more transducers to a drilling pipe for acoustic communication along the drilling pipe, the method comprising: providing a sub-pipe comprising a bore-defining surface defining an axially oriented bore therethrough, a connector at a first axial end, and a connector at a second axial end, at least one of the connectors connectable to the drilling pipe; and providing a transducer-holding assembly comprising one or more transducers; inserting the transducer-holding assembly into the bore of the sub-pipe from one of the first and second axial ends; and mounting the transducer-holding assembly in the bore of the sub-pipe to provide intimate contact which facilitates acoustic communication between the one or more transducers and the sub-pipe.

Another aspect of the invention provides a transducer assembly comprising: a transducer stack comprising a plurality of generally axially aligned transducers; a pair of threaded members located at a first axial end of the transducer stack and generally axially aligned with the transducer stack; a cap located at a second axial end of the transducer stack opposed from the first axial end; a first one of the pair of threaded members connected to at least one of the transducer stack and the cap, such that threadable adjustment of a second one of the pair of threaded members relative to the first one of the pair of threaded members causes the second one of the pair of threaded members to move axially relative to the first one of the threaded members and corresponding adjustment of an axial dimension of the transducer assembly.

A transducer-holding assembly for mounting one or more transducers in a sub-pipe and providing intimate contact which facilitates acoustic communication between the one or more transducers and the sub-pipe, the transducer-holding assembly comprising: one or more transducer assemblies; a transducer holder comprising one or more mounting features for holding the one or more transducer assemblies; each transducer assembly comprising: a transducer stack comprising a plurality of generally axially aligned transducers; a pair of threaded members located at a first axial end of the transducer stack and generally axially aligned with the transducer stack; wherein threadable adjustment of a second one of the pair of threaded members relative to the first one of the pair of threaded members causes the second one of the pair of threaded members to move axially relative to the first one of the threaded members and to bear against at least one of the one or more mounting features for corresponding adjustment of compressive force on the transducer stack.

Another aspect of the invention provides a method for assembling a plurality of transducers into a transducer assembly, the method comprising: axially aligning a plurality of transducers to provide a transducer stack; axially aligning a pair of threaded members at a first axial end of the transducer stack; locating a cap at a second axial end of the transducer stack, the second axial end opposed from the first axial end; and connecting a first one of the pair of threaded members to at least one of the transducer stack and the cap to provide a transducer assembly; wherein threadable adjustment of a second one of the pair of threaded members relative to the first one of the pair of threaded members causes the second one of the pair of threaded members to move axially relative to the first one of the threaded members and corresponding adjustment of an axial dimension of the transducer assembly.

Another aspect of the invention provides a method for assembling a transducer-holding assembly for mounting one or more transducers in a sub-pipe and providing intimate contact which facilitates acoustic communication between the one or more transducers and the sub-pipe, the method comprising: providing one or more transducer assemblies;

providing a transducer holder comprising one or more mounting features; and mounting the one or more transducer assemblies to the transducer holder; wherein providing the one or more transducer assemblies comprises, for each transducer assembly: axially aligning a plurality of transducers to provide a transducer stack; axially aligning a pair of threaded members at a first axial end of the transducer stack; and wherein mounting the one or more transducer assemblies to the transducer holder comprises, for each transducer assembly: threadably adjusting a second one of the pair of threaded members relative to a first one of the pair of threaded members to cause the second one of the pair of threaded members to move axially relative to the first one of the threaded members and to bear against at least one of the one or more mounting features for corresponding adjustment of compressive force on the transducer stack.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive

FIGS. 12A-12D (collectively, FIG. 12) shows several views of the feed-through of the FIG. 1 apparatus in isolation.

FIG. 15B is an exploded view of the FIG. 15A transducer-holder assembly and the FIG. 12 feed-through.

DESCRIPTION

Figure 1:
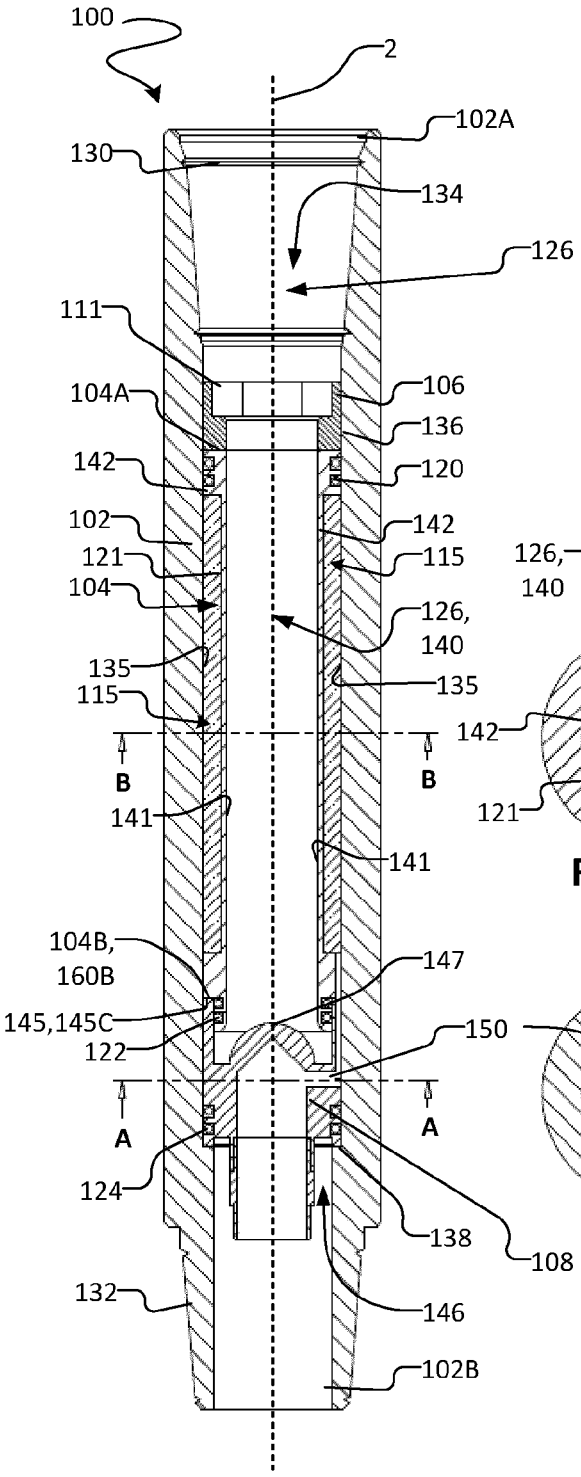
FIG. 1 is a cross-sectional view of an apparatus for mounting transducers inside the bore of a sub-pipe in accordance with a particular embodiment.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense. The same part of the invention appearing in more than one embodiment is designated by the same reference numeral.

FIGS. 1A-1D show various views of an apparatus 100 for operatively mounting transducers (e.g. piezoelectric actuators and/or the like) to a sub-pipe (or for brevity, a sub) 102 for acoustic communication according to a particular embodiment. Sub 102 may be a part of a drill string and may be connected between a pair of pipe stands (not shown) for effecting acoustic communication through the drill string. Sub 102 may additionally or alternative be connected to the end of a monolithic drill pipe (not shown) for effecting acoustic communication through the monolithic drill pipe.

When operatively mounted in sub 102, apparatus 100 may create acoustic (i.e. pressure) waves that may be launched into sub 102 and may be communicated from sub 102 to any connected drill string and/or pipe. With suitable modulation, such acoustic waves may be used to provide acoustic communication through sub 102 and any connected drill string and/or pipe. When operatively mounted in sub 102, apparatus 100 may receive acoustic waves from sub 102 and from any connected drill string and/or pipe and may generate corresponding electrical signals. Data may be extracted from such electrical signals via suitable receive circuitry.

In the illustrated embodiment, sub 102 is monolithic. Sub 102 may comprise a standard female rotary (e.g. threaded) connector component 130 at its first end 102A (the "box" end 102A) for connecting to a standard male connector component (not shown) of a pipe stand or other drill string component; and a standard male rotary (e.g. threaded) connector component 132 at its opposing second end 102B (the "pin" end 102B) for connecting to a standard female connector component (not shown) of another pipe stand or other drill string component. When so coupled between pipe stands or other drill string components, sub 102 becomes part of the drill string.

To facilitate a flow of drilling fluid (e.g. mud and/or the like) through the drill string and/or through apparatus 100, sub 102 comprises a bore-defining surface 135 which defines a bore 134 that extends from a first axial end 102A of sub 102 to a second opposing axial end 102B of sub 102. Bore 134 of sub 102 permits the flow of drilling fluid therethrough. As will be explained in more detail below, a transducer-holding assembly 104 is mounted in bore 134 of sub 102 to effect acoustic communication between transducer-holding assembly 104 and sub 102 and any connected pipe and/or drill string. When transducer-holding assembly 104 is mounted in bore 134, drilling fluid is still permitted to flow through sub 102.

For the purposes of explanation and description of apparatus 100, we may describe a notional axially oriented central axis 2 (shown in FIG. 1) that extends axially through the cross-sectional center of bore 134 from the first axial end 102A to the second axial end 102B of sub 102. Unless the context dictates otherwise, the terms "axial", "axially", and/or the like (as used herein) refer to directions that are parallel to central axis 2, or, where the context dictates, have components that extend in directions parallel to central axis 2. Unless the context dictates otherwise, the terms "radially outward", "radially outwardly", and/or the like (as used herein) refer to directions that extend orthogonal to and away from central axis 2 or, where the context dictates, have components that extend orthogonal to and away from central axis 2. Unless the context dictates otherwise, the terms "radially inward", "radially inwardly", and/or the like (as used herein) refer to directions that extend orthogonal and toward central axis 2 or, where the context dictates, have components that extend orthogonal to and toward central axis 2. Unless the context dictates otherwise, the terms "radial", "radially", and/or the like (as used herein) refer to directions that are either radially inward, radially outward or both. Although the term "radial" is most commonly used in connection with circular objects or features, it should be understood for the purpose of this description and accompanying claims that the term "radial" is used in a broader context and is not limited to describing circular objects or features or objects or features with circular cross-section.

Apparatus 100 comprises, in addition to sub 102, a transducer-holding assembly 104 which is mounted within sub-pipe bore 134. Apparatus 100 comprises an axially-extending channel 126 located within sub-pipe bore 134 for permitting fluid flow through apparatus 100 from a first axial end 102A of sub 102 to a second axial end 102B of sub 102 when transducer-holding assembly 104 is mounted within sub-pipe bore 134. In the illustrated embodiment of FIG. 1, transducer-holding assembly 104 comprises a transducer-holder bore-defining surface 141 that defines a channel or bore 140, which forms part of channel 126 through apparatus 100 and permits fluid flow through transducer-holding assembly 104 when transducer-holding assembly 104 is mounted within the sub-pipe bore 134.

In the illustrated embodiment, bore-defining surface 135 of sub 102 comprises a connector component 136 and an arrest 138. Connector component 136 and arrest 138 of bore-defining surface 135 may be used to operatively mount transducer-holding assembly 104 in sub-pipe bore 134 and may facilitate intimate contact (e.g. acoustic connection) of transducer-holding assembly 104 to sub 102 for acoustic communication along sub 102 and through any connected drill string and/or pipe.

In some embodiments, connector component 136 may be used to connect to a complementary connector component (not shown) on a tension collar portion (not shown) of transducer-holding assembly 104 for connection of transducer-holding assembly 104 to sub 102 within bore 134. In some embodiments as is the case in the illustrated embodiment of FIG. 1, connector component 136 may be used to connect to a complementary connector component 107 of a separate tension collar 106 (explained in more detail below and best seen in FIG. 11) for connection of tension collar 106 to sub 102 within bore 134. When so-connected, tension collar 106 may bear against a first axial end 104A of transducer-holding assembly 104 for indirect connection of transducer-holding assembly 104 to sub 102 through tension collar 106. This direct connection of a tension collar portion of transducer-holding assembly 104 to sub 102 or indirect connection of transducer-holding assembly 104 to sub 102 via separate tension collar 106 may provide intimate contact (e.g. acoustic connection) of transducer-holding assembly 104 to sub 102 for acoustic communication along sub 102 and through any connected drill string and/or pipe. As will be discussed in more detail below, connector component 136 and the complementary connector component of the tension collar portion of transducer-holding assembly 104 and/or the complementary connector component 107 of separate tension collar 106 may provide a connection which facilitates axial movement of the connected transducer-holding assembly 104 and/or the connected tension collar 106 relative to sub 102.

Arrest 138 of bore-defining surface 135 may be shaped to reduce a cross-section area of sub-pipe bore 134 in a region 134A of sub-pipe bore 134 relative to at least one region 134B of bore 134 adjacent to arrest 138. This may be best seen from FIG. 10A which shows a cross-section of sub 102 including bore-defining surface 135, arrest 138, reduced-cross-sectional-area region 134A of bore 134 and adjacent (relatively wide-cross-sectional-area) region 134B of bore 134. In some embodiments, the relatively wide-cross-sectional-area region 134B of bore 134 may extend all the way to a first axial end 102A of sub 102 to facilitate insertion of transducer-holding assembly 104 into bore 134 from first axial end 102A through wide-cross-sectional-area region 134B.

In some embodiments, arrest 138 may stop axial movement of transducer-holding assembly 104 as a feed-through portion (not shown) at a second axial end 104B of transducer-holding assembly 104 bears against arrest 138. In some embodiments (as is the case with the illustrated embodiment of FIG. 1), arrest 138 may stop axial movement of transducer-holding assembly 104 as second axial end 104B of transducer-holding assembly 104 bears against a separate feed-through 108 (explained in more detail below) and feed-through 108 bears against arrest 138. In the illustrated embodiment of FIGS. 1 and 10A, arrest 138 is a lipped arrest comprising an annular, axial-facing bearing surface 138A (FIG. 10A) against which the feed through portion at the second axial end 104B of transducer-holding assembly 104 may bear or against which separate feed-through 108 may bear. In some embodiments, arrest 138 may comprise one or more radially inwardly extending protrusions which reduce the cross-section area of bore 134 in reduced cross-section area region 134A and which provide one or more corresponding axial facing bearing surfaces against which the feed through portion at the second axial end 104B of transducer-holding assembly 104 or separate feed-through 108 may bear. In some embodiments, arrest 138 may comprise a threaded arrest which comprises a helical bearing surface against which the feed through portion at the second axial end 104B of transducer-holding assembly 104 or separate feed-through 108 may bear. This direct bearing of the feed through portion at the second axial end 104B of transducer-holding assembly 104 against arrest 138 or indirect bearing of transducer-holding assembly 104 against arrest 138 via separate feed-through 108 may provide intimate contact (e.g. acoustic connection) of transducer-holding assembly 104 to sub 102 for acoustic communication along sub 102 and through any connected drill string and/or pipe.

In the illustrated embodiment of FIG. 1, apparatus 100 comprises a separate feed-through 108 shown best in FIG. 12. Feed-through 108 of the FIG. 12 embodiment comprises: a transducer-holding assembly engaging portion 145 for engaging transducer-holding assembly 104, an electronics connector portion 149 for connection to an electronics housing 110 (see FIG. 1D), a sub-pipe engaging portion 151 for engaging arrest 138 and an axially-extending channel 146 permitting fluid flow therethrough. Transducer-holding assembly engaging portion 145 bears against or otherwise engages transducer-holding assembly 104 and sub-pipe engaging portion 151 bears against sub-pipe 102 to provide acoustic communication between the transducer assemblies supported by transducer-holding assembly 104 and sub-pipe 102 for communication of acoustic signals through any connected drill string and/or pipe.

Figure 10:
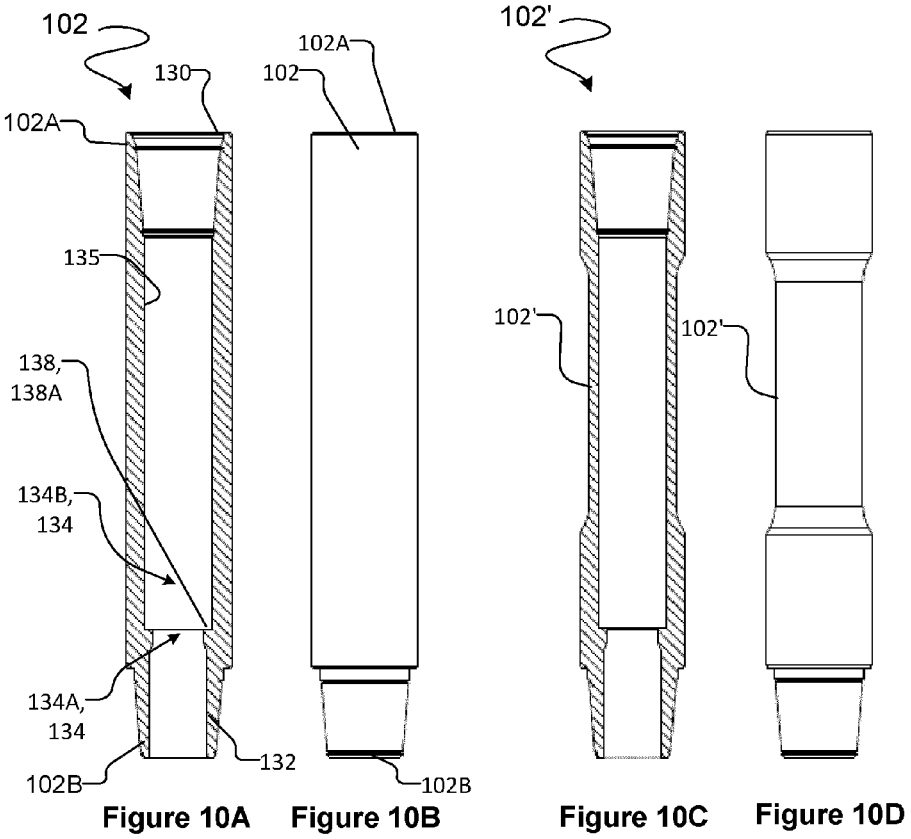
FIGS. 10A and 10B depict cross-sectional and plan views of a sub-pipe suitable for use with the apparatus of FIGS. 1, 5, 6, 8, 9 and 17 according to particular embodiments.
FIGS. 10C and 10D depict cross-sectional and plan views of another sub-pipe suitable for use with the apparatus of FIGS. 1, 5, 6, 8, 9 and 17 according to particular embodiments.

In the illustrated embodiment, where arrest 138 of sub 102 is shaped to reduce the cross-sectional area of bore 134 and comprises an axial-facing bearing surface (e.g. annularly shaped, axial-facing bearing surface 138A of the lipped arrest 138 shown in FIG. 10A or some other axial-facing bearing surface(s)), sub-pipe engaging portion 151 of feed-through 108 may be located at a radially outward portion of feed-through 108. Sub-pipe engaging portion 151 of feed-through 108 may comprise a radially outward facing surface 153 for abutting against bore-defining surface 135 of sub 102 and may comprise a complementary axial-facing bearing surface 151A for bearing against the axial-facing bearing surface 138A of arrest 138. In embodiments where arrest 138 comprises a threaded arrest, sub-pipe engaging portion 151 may comprise complementary threads for engaging the threads of arrest 138. In some embodiments, sub-pipe engaging portion 151 of feed-through may be annular in cross-section, although this is not necessary.

Figure 1B:
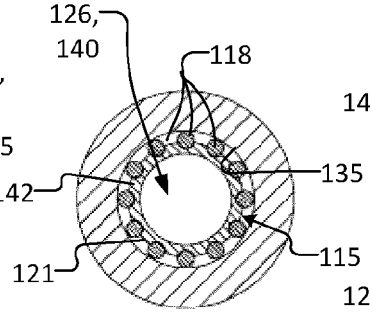
FIG. 1B is a sectional view of the FIG. 1 apparatus at B-B.
Figure 1C:
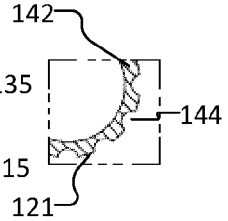
FIG. 1C is a magnified partial cross-sectional view of a portion of the transducer-holder of the FIG. 1 apparatus.
Figure 1A:
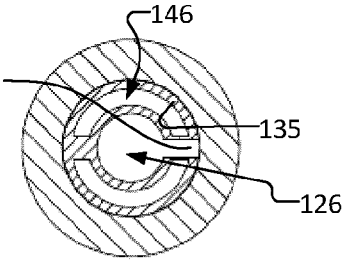
FIG. 1A is a sectional view of the FIG. 1 apparatus at A-A.
Figure 1D:
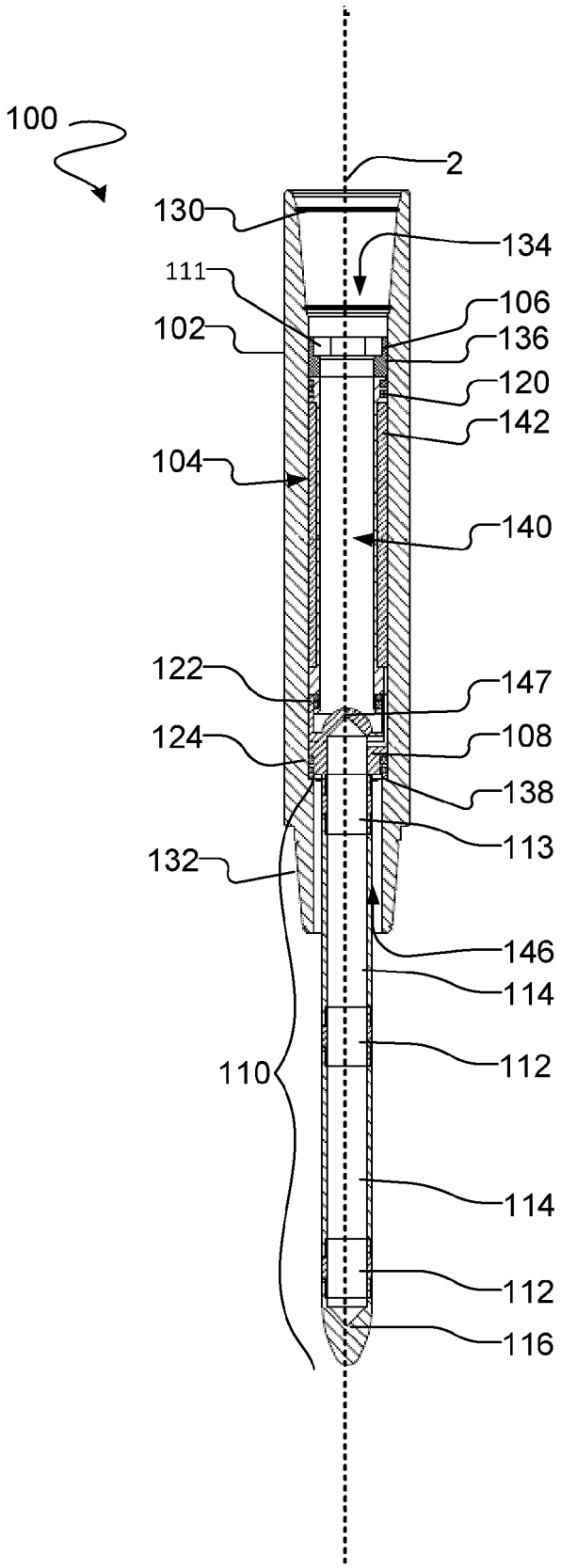
FIG. 1D is a cross-sectional view of the FIG. 1 apparatus with an electronics housing connected thereto.
Figure 2:
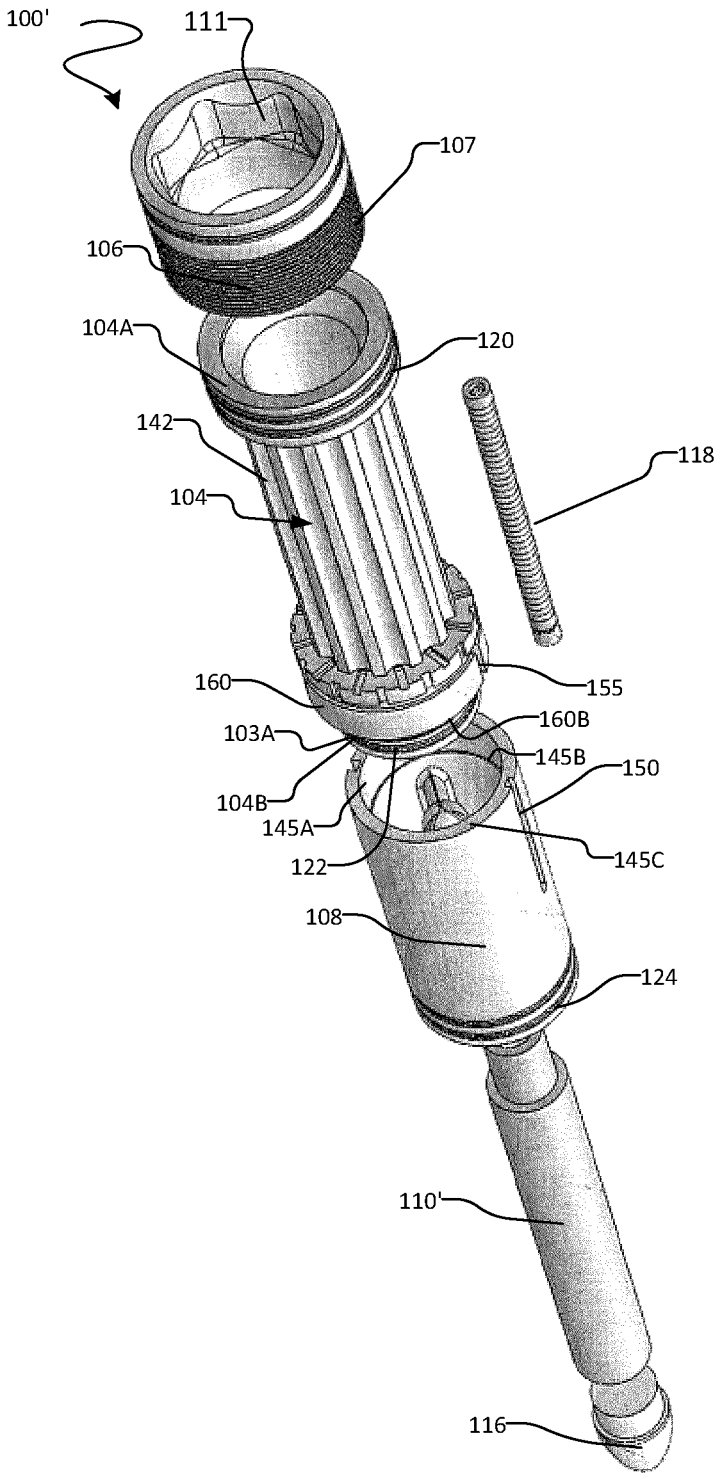
FIG. 2 is an exploded isometric view of the FIG. 1 apparatus for mounting transducers inside the bore of a sub-pipe with the sub-pipe, a number of transducer assemblies and a number of features of a number of other components removed for clarity.

Feed-through 108 of the FIG. 12 embodiment comprises an electronic connector portion 149 for connection to an electronics housing 110 (FIG. 1D). Electronics housing 110 may be referred to as a barrel housing 110. In the illustrated embodiment, connector portion 149 and electronics housing 110 are radially centered about central axis 2 (or are co-axial with central axis 2). This is not necessary. In general, electronic connector portion 149 and electronics housing 110 may be located at other radial locations relative to central axis 2. In the illustrated embodiment, a portion of electronics housing 110 (i.e. the portion that connects to feed through 108) is located inside bore 134 of sub 102 and another portion of electronics housing 110 extends axially out of the second end 102A of sub 102. In general, however, electronics housing 110 may be provided with any suitable length desirable to accommodate electronics associated with communication using apparatus 100 (or any other desired electronics). In the illustrated embodiments, electronic connector portion 149 is configured (e.g. sized and/or shaped) to provide a mechanical connection to a complementary connector component 113 at one axial end of electronics housing 110 (see FIGS. 2 and 3). In some embodiments, electronic connector portion 149 and complementary connector component 113 may comprise threads for connection to one another.

Feed-through 108 may also provide a route for extension of electrical connections (e.g. wires or the like) between electronics housing 110 and transducer-holding assembly 104. In the case of the FIG. 12 embodiment, feed-through 108 comprises one or more conduits 150 through which wires and/or the like may extend to electrically connect electronics, power source(s) and/or the like housed in electronics housing 110 to transducer assemblies 118 held in transducer-holding assembly 104. In the FIG. 12 embodiment, each conduit 150 extends from connector portion 149 to a radially outward surface 153 of feed-through 108 through a corresponding one of or more of arms 148 and then axially along radially outward surface 153 to the axial end of feed-through 108 proximate transducer-holding assembly 104. Accordingly, wires and/or the like may pass from the electronics housing, through connector components 113, 149 and through conduit 150 to transducer-holding assembly 104. In the illustrated embodiment of FIGS. 1 and 12, feed-through 108 is free to pivot about central axis 2. Accordingly, feed-through can be pivotally adjusted so that conduit 150 may be aligned with a corresponding wiring conduit 155 of transducer-holding assembly 104.

Feed-through 108 is shaped to provide an axially-extending channel 146 for permitting flow of drilling fluid through feed-through 108. In the illustrated embodiment of FIGS. 1 and 12, this axially-extending channel 146 is defined by the components of feed-through 108. Such channel-defining components of feed-through 108 may comprise electronics connection 149, radially inward facing surfaces 157 of sub-pipe engaging portion and arms 148 which extend between electronics connection 149 and sub-pipe engaging portion 151. In the illustrated embodiment of FIGS. 1 and 12, feed-through 108 comprises a plurality (e.g. two) arms 148, but this is not necessary. In some embodiments, feed through 108 could comprise one, two or more than three arms 148. In the illustrated embodiment of FIGS. 1 and 12, electronics connection 149 comprises a cone-shaped nosing 147 which radially narrows as it extends axially toward transducer-holding assembly 104. Nosing 147 may help to minimize (or at least reduce) disturbance to the flow of drilling fluid through feed-through 108.

In some embodiments, transducer-holding assembly 104 may comprise an integrally formed feed-through portion (not shown)—i.e. a feed-through portion which is not a separate component from transducer-holding assembly 104. In such embodiments, the feed-through portion of transducer-holding assembly 104 may comprise or provide features similar to those of feed-through 108 described herein, except where such features relate to the engagement of feed-through 108 with transducer-holding assembly 104 or the bearing of feed-through 108 and transducer-holding assembly 104 against one another. It will be appreciated that such features of engagement or bearing are not applicable where the feed-through is integrally formed with transducer-holding assembly 104.

Figure 11:
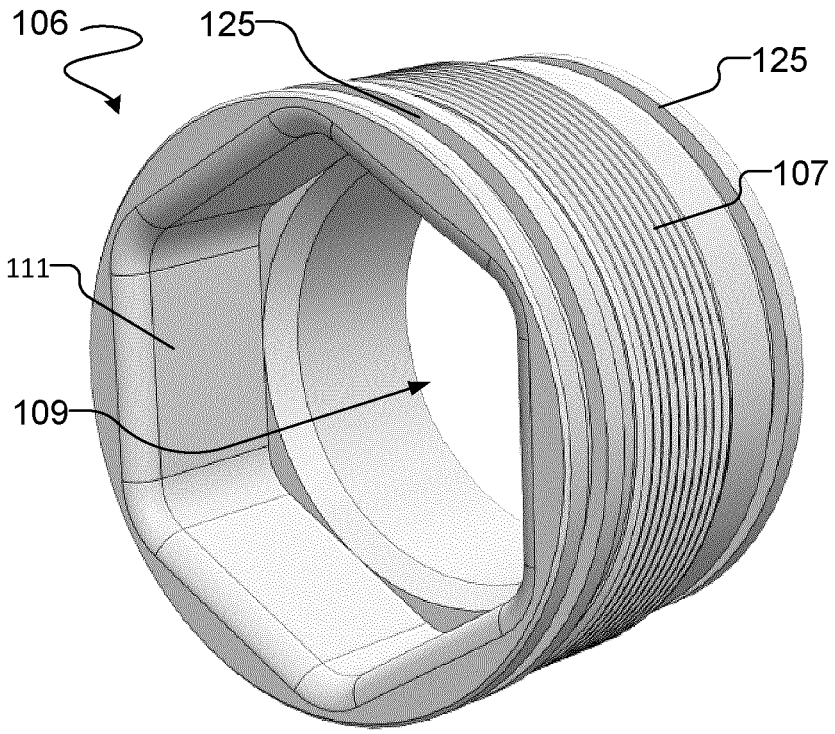
FIG. 11 shows the tension collar of the FIG. 1 apparatus in isolation.

Apparatus 100 of the FIG. 1 embodiment also comprises a separate tension collar 106 (also referred to as a tensioning nut 106) which is shown best in FIG. 11. Tension collar 106 of the illustrated embodiment comprises a connector component 107 for connection to complementary connector component 136 of bore-defining surface 135 of sub 102. The connection between connector components 107, 136 may permit axial adjustment of the position of tension collar 106 relative to sub 102 which may in turn permit adjustment of the force against which tension collar 106 bears against the first axial end 104A of transducer holding assembly 104. In the particular case of the illustrated embodiment of FIG. 1, connector components 107, 136 comprise threads (see FIGS. 2 and 11) which provide helical bearing surfaces as between tension collar 106 and sub 102. Note, for clarity, the threads of connector component 136 are not expressly shown in some of the drawings. In some embodiments, tension collar 106 may comprise one or more pressure bearing O-rings 125 to provide seals that help to prevent drilling fluid from entering the connection between connector components 136, 107.

Tension collar 106 of the illustrated embodiment may also comprise a tool-engaging portion 111 for engaging a corresponding tool (not shown) which may permit rotational adjustment of tension collar 106. In the illustrated embodiment, tool-engaging portion 111 comprises a female tool-engaging portion (e.g. a hex-shaped socket) 111 for receiving a corresponding male tool bit (e.g. a hex-shaped tool bit). More particularly, when tension collar 106 is located in bore 134 of sub 102, a tool may be extended into bore 134 (e.g. through first axial end 102A of sub 102) such that a bit of the tool engages tool-engaging portion 111 and may be used to rotate tension collar 106. In some embodiments, tool-engaging portion 111 is not required. In some embodiments, other shapes and/or techniques may be used for gripping and/or otherwise engaging and/or rotating tension collar 106.

In the illustrated embodiment, where tension collar 106 comprises threads 107 that are threadably connected to the threaded connector component 136 of bore-defining surface 135, suitable rotation of tension collar 106 may cause tension collar 106 to move axially relative to sub 102 (e.g. toward or away from the transducer-holding assembly 104). Control of this movement may in turn permit control over the axial forces by which tension collar 106 bears on first axial end 102A of transducer-holding assembly 104, the axial forces by which transducer-holding assembly 104 bears against feed-through 108 and feed-through 108 bears against arrest 138 and/or the corresponding compressive forces by which transducer-holding assembly 104 is axially compressed between tension collar 106 and feed-through 108 (which in turn bears against arrest 138). As explained in more detail below, through these abutting and threaded connections, transducer-holding assembly 104 (via tension collar 106 and feed-through 108) may be mounted in the bore 134 of sub 102 in a compressed state and in intimate contact for acoustic coupling with sub 102.

Tension collar 106 provides one or more axially extending channels to permit axial fluid flow (e.g. of drilling fluid) therethrough. In the illustrated embodiment of FIGS. 1 and 11, tension collar 106 comprises a centrally located channel 109. Channel 109 through tension collar 106 comprises part of channel 126 through apparatus 100 and permits the flow of drilling fluid between the bore 140 of transducer-holding assembly 104 to a portion of sub-pipe bore 134 downstream of transducer-holding assembly 104 and to an adjacent pipe stand (not shown).

In some embodiments, transducer-holding assembly 104 may comprise an integrally formed tension collar portion (not shown)—i.e. a tension collar portion which is not a separate component from transducer-holding assembly 104. In such embodiments, the tension collar portion of transducer-holding assembly 104 may comprise or provide features similar to those of tension collar 106 described herein, except where such features relate to the engagement of tension collar 106 with transducer-holding assembly 104 or the bearing of tension collar 106 and transducer-holding assembly 104 against one another. It will be appreciated that such features of engagement or bearing are not applicable where the tension collar portion is integrally formed with transducer-holding assembly 104.

Referring to FIGS. 1-4, apparatus 100 of the illustrated embodiment is assembled by inserting feed-through 108, transducer-holding assembly 104 and tension collar 106 into bore 134 of sub 120 from first axial end 102A of bore 102. More particularly, feed-through 108 may be inserted first into bore 134 of sub 102 from first axial end 102A, such that the feed-through 108 bears (e.g. abuts against) arrest 138 of bore-defining surface 135. In the illustrated embodiment, axial-facing bearing surface 151A of sub-pipe engaging portion 151 abuts against complementary axial-facing bearing surface 138A of arrest 138. After feed-through 108, transducer-holding assembly 104 may then be inserted into bore 134 from first end 102A of sub 102. Second axial end 104B of transducer-holding assembly 104 may then engage or otherwise bear against transducer-holding assembly engaging portion 145 of feed-through 108 for application of bearing force and corresponding acoustic communication between transducer-holding assembly 104 and feed-through 108.

In the illustrated embodiment, second end 104B of transducer-holding assembly 104 and transducer-holding assembly engaging portion 145 of feed-through 108 comprise optional complementary engaging features which help them to engage or otherwise bear against one another. More particularly, in the illustrated embodiment (as shown best in FIG. 12), transducer-holding assembly engaging portion 145 of feed-through 108 comprises a recessed surface 145A (where sub-pipe engaging portion 151 is relatively radially thin) and one or more corresponding shoulders 145B (where sub-pipe engaging portion 151 is relatively radially thick). Similarly, as shown best in FIGS. 2-4, 14, 15A and 15B, second end 104B of transducer-holding assembly 104 may comprise a recessed surface region 103A (where the radial location (relative to central axis 2) of the radially outward facing surface of transducer-holding assembly 104 is relatively small) and a corresponding shoulder 103B (where the radial location (relative to central axis 2) of the radially outward facing surface of transducer-holding assembly 104 is relatively large) which are complementary to recessed region 145A and shoulder 145B of transducer-holding assembly engaging portion 145. Recessed surface region 103A and shoulder 103B of transducer-holding assembly 104 may be best seen in FIGS. 14 and 15. Together, recessed regions 145A, 103A and shoulders 145B, 103B help to engage second end 104B of transducer-holding assembly 104 to transducer-holding assembly engaging portion 145 of feed-through 108 to permit communication of acoustic signals therebetween. In the illustrated embodiment, transducer-holding assembly engaging portion 145 of feed-through 108 also comprises an axially facing end surface 145C and second end 104B of transducer-holding assembly 104 comprises a first axially facing surface 160B of second flange 160. In the illustrated embodiment, axially facing end surface 145C of feed-through 108 abuts and bears against corresponding axially facing surface 160C of second end 104B of transducer-holding assembly 104 to help engage transducer-holding assembly engaging portion 145 of feed-thorugh 108 to second end 104B of transducer-holding assembly 104 and to permit communication of acoustic signals therebetween.

In some embodiments, feed-through 108 may comprise one or more alignment apertures 163 and transducer-holding assembly 104 may comprise one or more complementary alignment recesses 162. Set screws 164 or other suitable fasteners may project radially inwardly through alignment apertures 163 and into alignment recesses 162 to maintain an axial alignment of transducer-holding assembly 104 and feed through 108 during assembly and operation of apparatus 100. In particular, alignment recesses 162 and apertures 163 and set screws 164 aid in maintaining axial alignment of conduit 150 of feed-through 108 with wiring conduit 155 of transducer-holding assembly 104 for protection of wires/electrical connectors that run therethrough. In some embodiments, other types of fasteners could be used to maintain this axial alignment. In some embodiments, other engaging features may be provided to help second axial end 104B of transducer-holding assembly 104 to engage or otherwise bear against transducer-holding assembly engaging portion 145 of feed-through 108 for application of bearing force and corresponding acoustic communication between transducer-holding assembly 104 and feed-through 108. In some embodiments, such engaging features are not necessary.

After insertion of transducer-holding assembly 104, tension collar 106 may be inserted into bore 134 through first axial end 102A of sub 102. As discussed above, connector component 107 of tension collar 106 may then be connected to complementary connector component 136 of bore-defining surface 135 of sub 102 such that tension collar 106 abuts or otherwise bears against first axial end 104A of transducer-holding assembly 104 for application of bearing force and corresponding acoustic communication between transducer-holding assembly 104 and tension collar 106. The connection between tension collar 106 and bore-defining surface 135 may then be adjusted to move tension collar 106 axially in bore 134 relative to sub 102. In the illustrated embodiment, where connector components 107, 136 comprise complementary threads, this axial adjustment of the position of tension collar 106 relative to sub 102 may be accomplished by rotation of tension collar 106 about central axis 2.

As discussed above, axial adjustment of the position of tension collar 106 relative to sub 102 can be used to control any one or more of: the force by which tension collar 106 bears against first axial end 104 of transducer-holding assembly 104; the force by which transducer-holding assembly engaging portion 145 of feed-through 108 bears against second axial end 104B of transducer-holding assembly 104; the force by which feed-through 108 bears against arrest 138 of sub 102; and the force by which transducer-holding assembly 104 is compressed between tension collar 106 and feed-through 108. Control of these forces may be used to provide intimate contact between the corresponding components and corresponding acoustic communication between the transducer assemblies supported by transducer-holding assembly 104 and sub-pipe 102 for communication of acoustic signals through any connected drill string and/or pipe. In some particular non-limiting embodiments, tension collar 106 may be tightened by rotation at a torque of 250 ft-lbs (+/−10%) to provide approximately 1000 lbs of axial compression to transducer-holding assembly. In some embodiments, this torque range is in a range of 100-500 ft-lbs. In some embodiments, this compression is in a range of 500-2000 lbs. In some embodiments, the compression may be sufficient to maintain intimate acoustic contact between a transducer-holding assembly 104 and sub 102 throughout a temperature range of 0° C. to +175° C. and to maintain intimate acoustic contact between transducer-holding assembly 104 and sub 102 when transducer assemblies 118 held by transducer-holding assembly 104 expand and contract.

Apparatus 100 may conveniently, but not necessarily, comprise a plurality of pressure bearing O-rings to help provide seals that may be sufficient to prevent drilling fluid from entering the transducer-holding assembly 104 between abutting components. In the FIG. 1 embodiment (as shown best in FIGS. 1 and 2), a plurality of pressure bearing O-rings (e.g. Viton™ O-rings and/or the like) 120, 122 are mounted within corresponding circumferential recesses in the radially outward facing surfaces of transducer-holding assembly 104. Similar O-rings 124 may be mounted within corresponding circumferential recesses in the radially outward facing surface of feed-through 108. These O-rings 120, 122, 124 may provide seals between transducer-holding assembly 104 and bore-defining surface 135 of sub 102 (O-rings 120), between transducer-holding assembly 104 and feed-through 108 (O-rings 122) and between feed-through 108 and bore-defining surface 135 of sub 102 (O-rings 124). These seals may be sufficient to prevent drilling fluid from entering the cavity 115 where transducer assemblies 118 are housed between transducer holder 142 of transducer-holding assembly 104 and electronics housing 110. In the illustrated embodiment, a plurality of each of O-rings 120, 122, 124 are provided to provide more robust seals, although this is not necessary.

Figure 14:
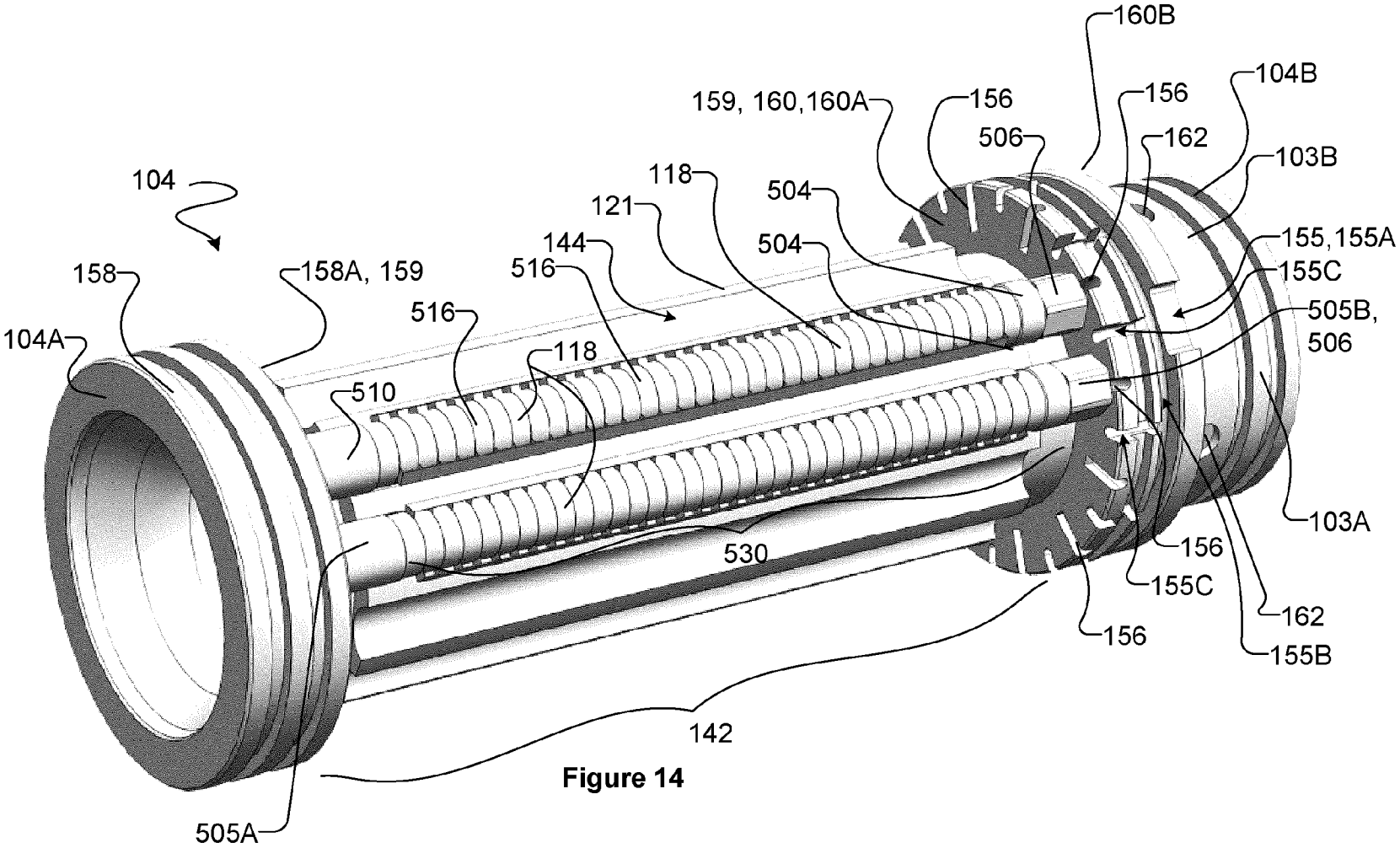
FIG. 14 is an isometric view of the FIG. 1 transducer-holding assembly showing a transducer-holder holding a pair of transducer assemblies in accordance with a particular embodiment.

We now turn to the description of transducer-holding assembly 104. Transducer-holding assembly 104 may comprise transducer holder 142 and one or more transducer assemblies 118. FIG. 14 shows more detail of the transducer-holding assembly 104 of the FIG. 1 embodiment. For clarity, only two transducer assemblies 118 are shown in FIG. 14. FIG. 15 shows transducer holder 142 of the FIG. 1 embodiment without transducer assemblies 118. As explained in more detail below, transducer assemblies 118 according to particular embodiments may each comprise one or more suitable transducers or actuators (e.g. piezoelectric transducers/actuators, magnetostrictive transducers/actuators, electromechanical transducers/actuators and/or the like). Transducer assemblies 118 may be electronically controlled (e.g. by suitable electronics contained in electronics housing 110) to change their shape or to otherwise move. Such shape changes or other movement of transducer-assemblies 118 may be acoustically communicated to transducer holder 142 which is in turn acoustically coupled to sub 102 (as described above—e.g. through tension collar 106 and feed-through 108) for acoustic communication of the shape changes or movement of transducer assemblies 118 into sub 102 and through sub 102 to any connected drill string and/or pipe. It will be appreciated that such shape changes or movements of transducer assemblies can be suitably modulated for acoustic communication through sub 102 to any connected drill string and/or pipe.

In the FIG. 1 embodiment, when transducer-holder 142 is inserted into bore 134 of sub 102, transducer holder 142 together with sub 102 define a cavity 115 for housing a plurality of transducer assemblies 118. Cavity 115 of the FIG. 1 embodiment is best shown in FIG. 1B. Cavity 115 of the FIG. 1 embodiment may have a generally annular cross-sectional shape which may be defined (in radial directions) between a radial outward surface 121 of transducer holder 142 and bore-defining surface 135 of sub 102 and which may be defined (in axial directions) by the first and second axial-facing flange surfaces 158A, 160A of first and second flanges 158, 160 of transducer holder 142 (see FIGS. 14 and 15). In some embodiments, air gaps in cavity 115 may be filled with a high temperature potting compounding such as Sylgard™ (manufactured by Dow Corning) and/or the like.

Figure 13C:
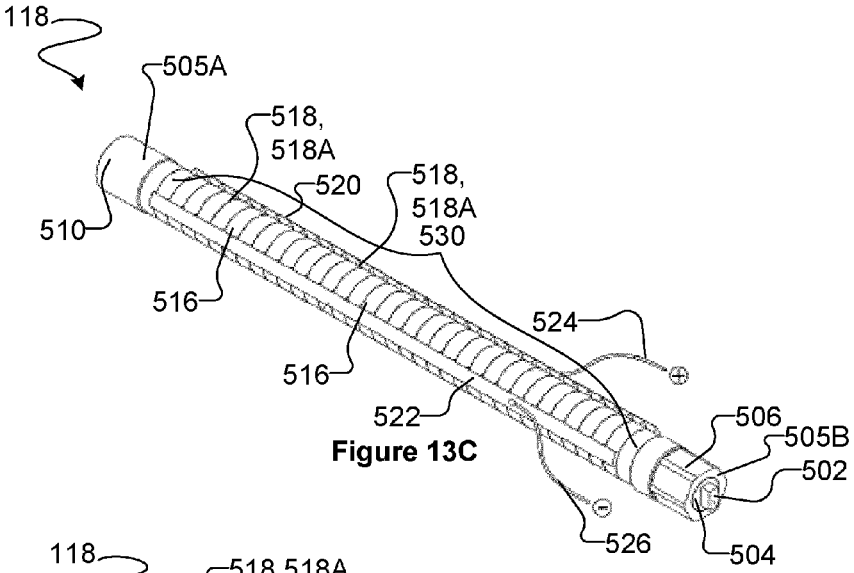
FIGS. 13A-13C (collectively, FIG. 13) shows various views of a transducer assembly suitable for use with the apparatus of FIGS. 1, 5, 6, 8, 9 and 17 according to particular embodiments.
Figure 13B:
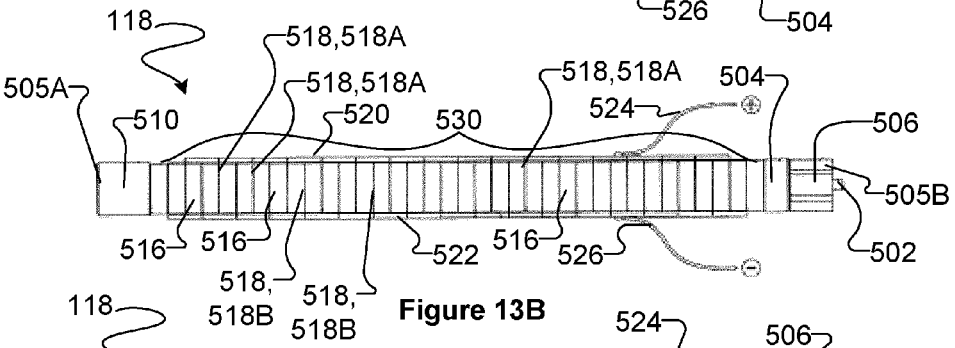
Figure 13A:
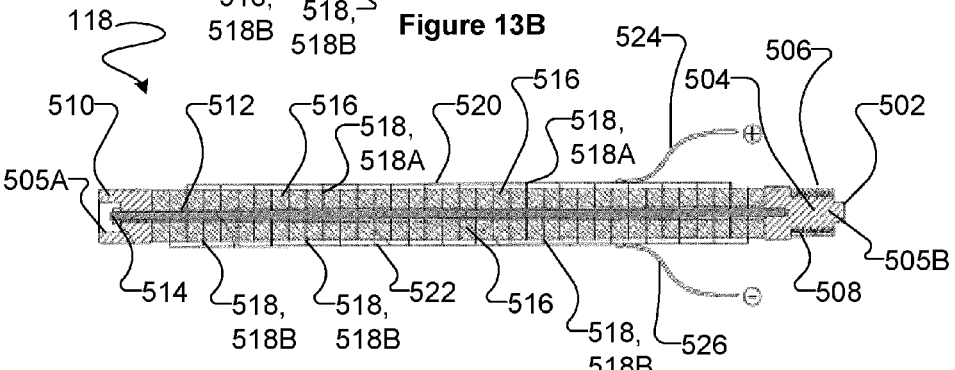
Figure 17A:
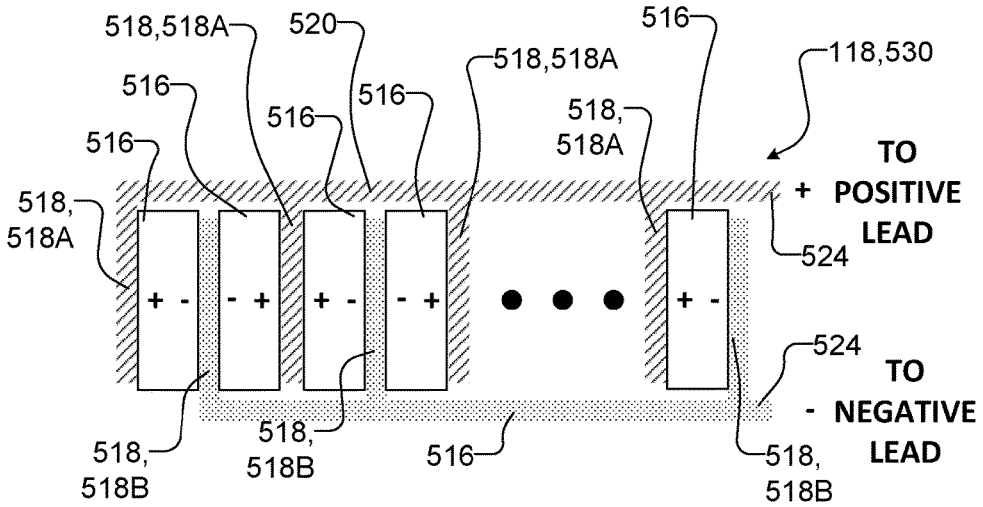
FIG. 17A is a schematic depiction of the alternating polarity and parallel wiring of transducer elements which may be used in the FIG. 13 transducer assembly for transmission of acoustic signals into the sub-pipe according to an example embodiment.
Figure 17B:
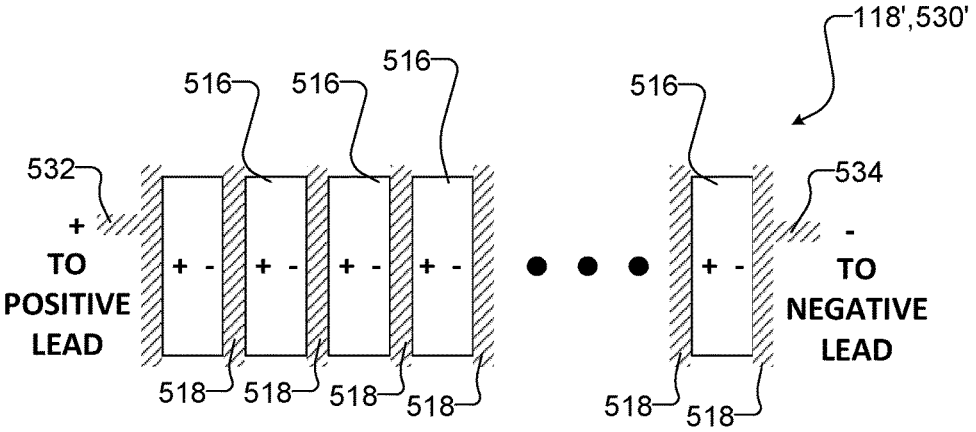
FIG. 17B is a schematic depiction of the aligned polarity and series wiring of transducer elements which may be used in the FIG. 13 transducer assembly for receiving acoustic signals from the sub-pipe according to an example embodiment.

FIG. 13 shows various views of a transducer assembly 118 according to a particular embodiment. Transducer assembly 118 may be used to provide each of transducer assemblies 118 of the FIG. 1 embodiment. FIG. 14 shows a transducer assembly 104 comprising transducer assemblies 118, two of which are shown in FIG. 14. FIG. 17A is a schematic depiction of a transducer assembly 118 showing the alternating polarity and parallel wiring of transducer elements 516 which may be used in the FIG. 13 transducer assembly 118 for transmission of acoustic signals into sub 102 according to an example embodiment. FIG. 17B is a schematic depiction of transducer assembly 118' showing the aligned polarity and series wiring of transducer elements 516 which may be used for receiving acoustic signals from sub 102 according to an example embodiment.

Transducer assembly 118 of the FIG. 13 embodiment comprises a plurality of transducers elements 516, and a pair of complementary (e.g. male and female) threaded members 504, 506 that are generally axially aligned. The axial alignment of transducer assembly 118 and its components may be best seen in FIG. 14. In the illustrated embodiment of FIGS. 13 and 14, the plurality of transducer elements 516 provides a piezoelectric stack 530 and each individual transducer element 516 comprises a piezoelectric transducer element 516. Piezoelectric transducer elements 516 may comprise piezoelectric actuators (e.g. piezoelectric ceramic discs or piezoelectric annular shaped members) which are configured to respond to electrical stimuli (e.g. applied electric field) by deformation (e.g. stretching and/or contracting) in axial direction(s). Piezoelectric transducer elements 516 are also responsive to applied forces (e.g. compressive force and/or expansion force) by generating corresponding electrical signals. In the FIG. 13 embodiment, the pair of threaded members 504, 506 comprises a male threaded member (e.g. a bolt) 504 and a female threaded member (e.g. a nut) 506.

In the FIG. 13 embodiment, piezoelectric transducer elements 516 are axially aligned with one another to provide piezoelectric stack 530 and piezoelectric stack 530 is positioned between cap 510 at one axial end 505B of transducer assembly 118 and threaded members 504, 506 at the opposing axial end 505A of transducer assembly 118. In some embodiments, one of the pair of threaded members 504, 506 comprises key-shaped protrusion or a protrusion-receiving slot. In the illustrated embodiments, male threaded member 504 comprises an axially extending protrusion (also referred to as a key) 502, which (as explained in more detail below) may extend axially into an axially recessed slot (also referred to as a recess) 156 on a flange 158, 160 of transducer holder 142. In some embodiments, cap 510 may comprise a similar axially extending protrusion or a protrusion-receiving slot.

The axial length of transducer assembly 118 may be adjusted by relative rotation of the pair of threaded members 504, 506. In the illustrated embodiments, one of threaded members 504, 506 (e.g. male threaded member 504 in the case of the illustrated embodiment) is connected to cap 510 at the opposing axial end 505A of piezoelectric stack 530 or is otherwise connected to piezoelectric stack 530, such that when the other one of threaded members 504, 506 (e.g. female threaded member 506 in the case of the illustrated embodiment) is rotated, the rotated one of the threaded members 504, 506 moves axially relative to the connected one of the threaded members 504, 506. In the case of the illustrated embodiment, when female threaded member 506 rotates relative to male threaded member 054, female threaded member 540 moves axially along shank 508 of male threaded member 504. This relative rotation of threaded members 504, 506 may extend or reduce the axial length of transducer assembly 118. In the case of the illustrated embodiment, female threaded member 506 may move relative to male threaded member 504 to extend or reduce the axial length of transducer assembly 118 (e.g. where an axial end of female threaded member 506 provides axial end 505B of transducer assembly 118 and an opposing axial end of cap 510 is the opposing axial end 505A of transducer assembly 118). In some embodiments, the configuration of female threaded member 506 and male threaded member 504 may be reversed. In such embodiments, female threaded member 506 is connected to cap 510 at the opposing axial end of piezoelectric stack 530 or is otherwise connected to piezoelectric stack 530, such that as male threaded member 506 is rotated relative to female threaded member 506, male threaded member 506 extends or reduces the axial length of transducer assembly 118 (e.g. where an axial end of male threaded member 504 is axial end 505B of transducer assembly 118 and an opposing axial end of cap 510 is the opposing axial end 505A of transducer assembly 118).

Transducer assembly 118 may comprise a rod 512 which connects one of threaded members 504, 506 to cap 510. Rod 512 may be fabricated from and/or coated with an electrically insulating material. In the illustrated embodiment, rod 512 connects cap 510 to male threaded member 504. In some embodiments, however, rod 512 could connect cap 510 to female threaded member 506 as described above. Rod 512 may be connected to cap 510 and/or to the one of the threaded members 504, 506 by any suitable connections (e.g. threaded connection, welded connections, pressure fit connections and/or the like). In the illustrated embodiment, rod 512 is connected to cap 510 at threaded connection 514. In some embodiments, rod 512 may be integrally formed with cap 510 and/or one of threaded members 504, 506. Rod 512 may also provide an aid for aligning and/or stacking individual annular shaped piezoelectric transducer elements 516 and annular shaped electrode shims (e.g. electrode washers) 518. That is, rod 512 may project through the apertures of annular shaped piezoelectric transducer elements 516 and annular shaped electrode washers 518 before connection of one of cap 510 and one of threaded members 504, 506 to rod 512 and then once annular shaped piezoelectric transducer elements 516 and annular shaped electrode washers 518 are mounted on rod 512 (e.g. by projection of rod 512 through their apertures), the other one cap 510 and one of threaded members 504, 506 may be connected to rod 512 to form transducer assembly 118. In this manner, the parts of transducer assembly 118 may be maintained in axial alignment during assembly of apparatus 100. The axial length of transducer assembly 118 and/or the relative positions of threaded members 504, 506 may be adjusted once transducer assembly 118 is mounted in transducer holder 172, as discussed below, to achieve a desired level of pre-compression of transducer assembly 118 so that transducer assembly 118 behaves as expected in response to electrical stimulation and/or external forces.

Transducer assembly 118 of the FIG. 13 embodiment is configured for use to transmit acoustic signals into sub 102 in response to electrical stimulation (e.g. from a suitable driver circuit (not shown)). In particular embodiments, transducer assembly 118 may be configured for transmission of acoustic signals into sub 102 by alternating the polarity of each adjacent transducer element 516 and by wiring transducer elements 516 in parallel as shown in FIG. 17A. It can be seen from FIG. 17A that each adjacent pair of transducer elements 516 is assembled into stack 530 with alternating polarity orientation—i.e. adjacent transducer elements 516 are oriented with positive polarity to positive polarity and negative polarity to negative polarity. In some embodiments, additional annular shaped grounding and or cooling washers (not shown) may be provided within each piezoelectric stack 530 (e.g. between axially adjacent piezoelectric transducer elements 516). In some embodiments, additional annular shaped temperature compensation washers (not shown) comprising temperature expansion compensating material, such as brass and/or the like, may be provided within each piezoelectric stack 530 (e.g. between axially adjacent piezoelectric transducer elements 516). For the purposes of interpreting transducer assemblies 118 and their components, the term "annular" and similar terms should be interpreted broadly. Specifically, the term "annular" in relation to transducer elements 516, electrode washers 518, grounding washers, cooling washers and/or temperature compensating washers is not limited to a shape having a circular perimeter. These components could have perimeters with other shapes (e.g. ellipsoid, polygonal and/or the like). Further, while these components are apertured, the shape of their apertures need not be circular and could have other shapes (e.g. ellipsoid, polygonal and/or the like).

In the illustrated embodiment of FIG. 13, annular shaped electrode washers 518 are located in piezoelectric stack 530 (e.g. in axial alignment with piezoelectric transducer elements 516 and, in some embodiments, axially aligned on rod 512) between axially adjacent pairs of piezoelectric transducer elements 516. In the embodiment of FIGS. 13 and 17A, where transducer assembly 118 is configured for transmission of acoustic signals into sub 102, positive polarity electrode washers 518A (e.g. electrode washers 518A on positive axial sides of piezoelectric transducer elements 516) may be soldered (or otherwise electrically connected) to a first (positive) runner 520. A positive electrical lead (e.g. a positive connecting wire) 524 may be soldered (or otherwise electrically connected) to runner 520. Negative polarity electrode washers 518B (e.g. electrode washers 518B on negative axial sides of piezoelectric transducer elements 516) may be soldered (or otherwise electrically connected) to a second (negative) runner 522 (see FIG. 13). A negative electrical lead (e.g. a negative connecting wire) 526 may be soldered (or otherwise electrically connected) to runner 522. Positive and negative electrical leads (e.g. wires) 524, 526 may be routed to electronics housing 110 through feed-through 108 as described elsewhere in this disclosure. Electronics housing 110 may be provided with (e.g. may contain) suitable drive circuitry (not shown) for providing suitable electrical stimulation signals on leads 524, 526. Data may be modulated into or otherwise carried by such electrical signals and, when transducer elements 516 and transducer assembly 118 deform in response to such data, such data may be acoustically transmitted into sub 102 via acoustic communication between transducer elements 516, transducer assemblies 118, transducer-holding assembly 104 and sub 102.

It will be appreciated that transducer elements 516 are not only responsive to electrical stimuli (e.g. by deformation), but may also be responsive to externally applied forces by generating corresponding electrical signals. This feature of transducer elements 516 can be used to provide transducer assemblies configured to receive acoustic signals and to generate corresponding electrical signals. FIG. 17B is a schematic depiction of transducer assembly 118' configured for use to receive an acoustic signal from sub 102 and to generate corresponding electrical signals according to a particular embodiment. In many respects, receive-configured transducer assembly 118' is substantially similar to transducer assembly 118 described elsewhere in this disclosure. Except where the context dictates otherwise, references to transducer assembly 118 in this disclosure should be understood to include the additional or alternative possibility of receive-configured transducer assembly 118'. Except where the context dictates otherwise, receive-configured transducer assembly 118' may comprise features, alternative features and modifications that are similar to those of transducer assembly described elsewhere herein.

Receive-configured transducer assembly 118' may be configured for receiving acoustic signals from sub 102 by aligning the polarity of each adjacent transducer element 516 and by wiring transducer elements 516 in series as shown in FIG. 17B. It can be seen from FIG. 17B that each adjacent pair of transducer elements 516 is assembled into stack 530' with aligned polarity orientation—i.e. adjacent transducer elements 516 are oriented with positive polarity to negative polarity and negative polarity to positive polarity. In the illustrated embodiment, annular shaped electrode washers 518 are located in piezoelectric stack 530' (e.g. in axial alignment with piezoelectric transducer elements 516 and, in some embodiments, axially aligned on rod 512) between axially adjacent pairs of piezoelectric transducer elements 516. In some embodiments of transducer assembly 118' and/or transducer stack 530', electrode washers 118 may not be required. In the embodiment of FIG. 17B, where transducer assembly 118' is configured for receiving acoustic signals from sub 102, electrode washers 118 connect adjacent transducer elements 516 to one another in series, such that all of the transducer elements 516 n transducer stack 530' are electrically connected in series between positive lead 532 and negative lead 534. Positive and negative leads 532, 534 (e.g. wires) may be routed to electronics housing 110 through feed-through 108 as described elsewhere in this disclosure. Electronics housing 110 may be provided with (e.g. may contain suitable receiver circuitry (not shown) for receiving suitable electrical signals from leads 532, 534. Where data is acoustically transmitted through sub 102 (e.g. through a pipe string from an uphole transmitter), such acoustically transmitted data may be acoustically communicated via sub 102, transducer-holding assembly 104, transducer assemblies 118' and transducer elements 516 and may be represented in the electrical signals on leads 532, 534. Such data may be extracted from the these electrical signals by the receive circuitry.

Figure 15A:
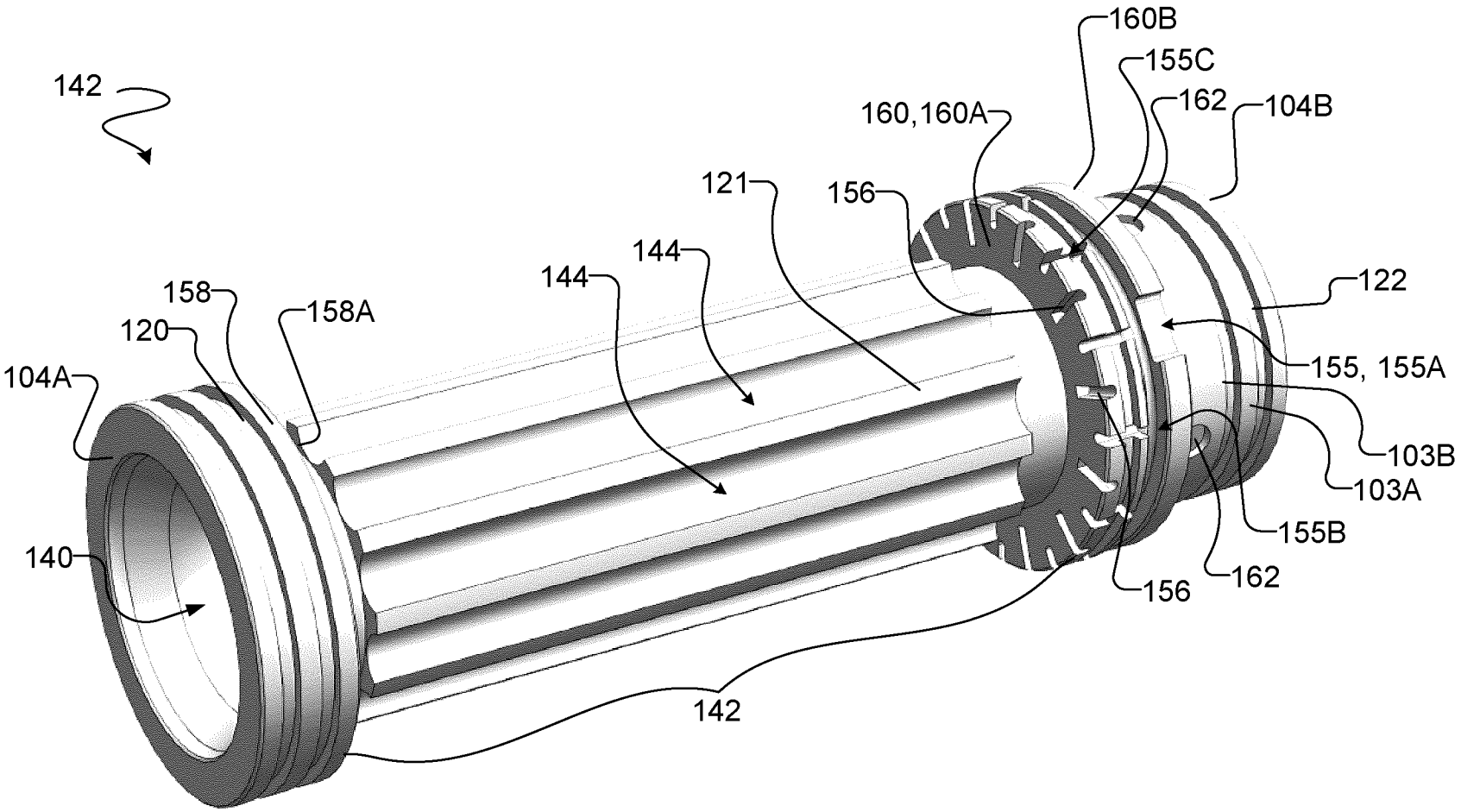
FIG. 15A is an isometric view of the FIG. 14 transducer-holder with the transducer assemblies removed for clarity.
Figure 15B:
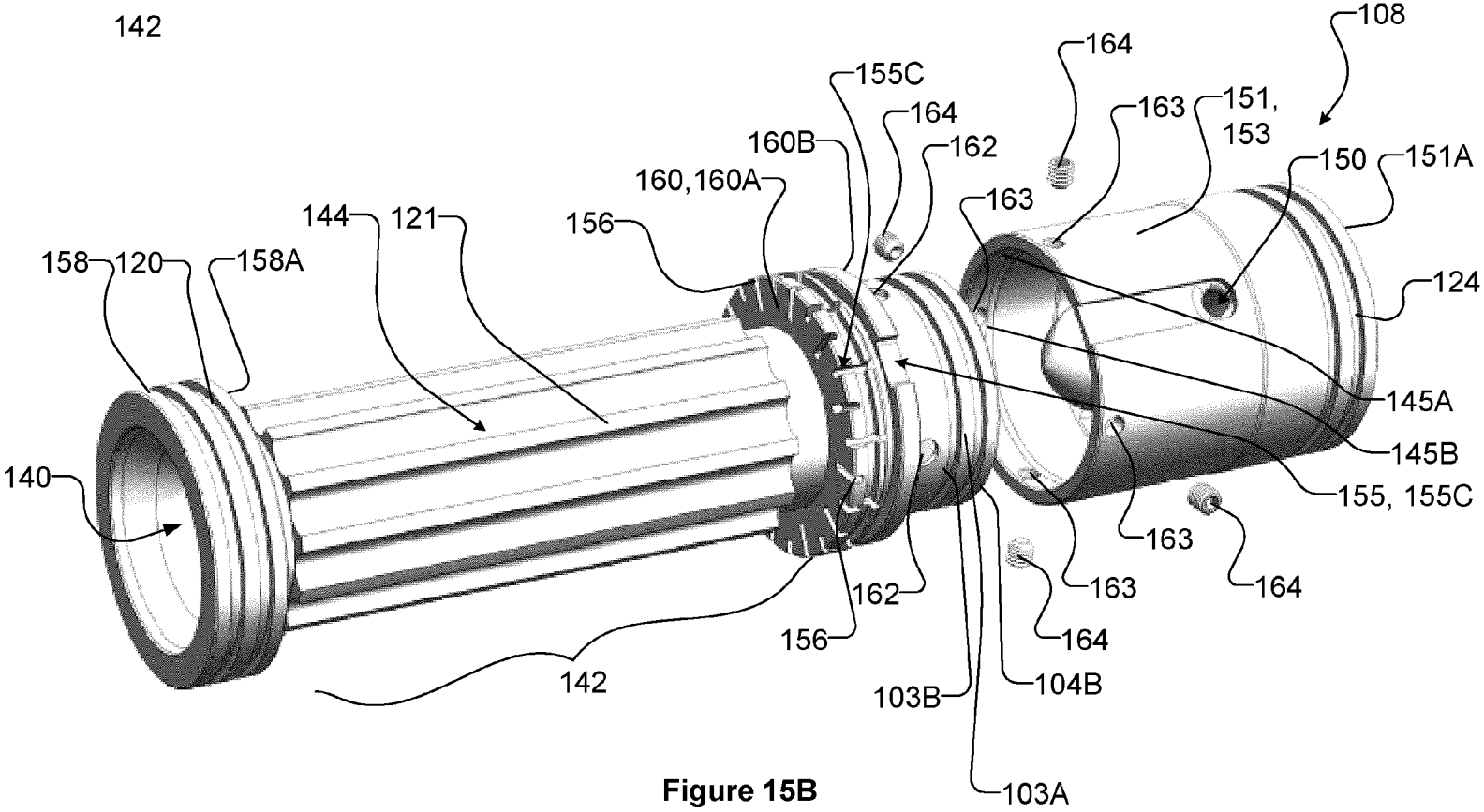

Returning now to the description of transducer-holding assembly 104, we next focus on transducer holder 142 (also referred to as a mule or mandrel) which is shown best in FIGS. 14 and 15. Transducer holder 142 may provide the general shape of transducer-holding assembly 104 including first and second axial ends 104A, 104B and recessed regions 103A and shoulder 103B of second axial end 104B. Transducer holder 142 comprises one or more transducer mounting features 159 for mounting the one or more transducer assemblies 118 to transducer holder 142. In the illustrated embodiment, transducer holder 142 provides one or more wiring conduits 155 (see FIGS. 14, 15A and 15B) for passing electrical leads (e.g. wires) that connect transducer assemblies 118 mounted in transducer holder 142 to electronics housed in electronics housing 110 via conduit 150 of feed-through 108. In the illustrated embodiment, wiring conduit 155 comprises a principal conduit notch 155A that accepts electrical leads (e.g. wires) from electronics housing 110 (via conduit 150 of feed-through 108 (see FIG. 12)) and leads to circumferential conduit channel 155B through which wires can extend until they reach a suitable axially extending conduit channel 155C through which wires can run to their corresponding transducer assembly 118. In the illustrated embodiment, one axially extending conduit channel 155C is provided between each pair of transducer assemblies, although this is not necessary. It may be desirable to align transducer-holding assembly 104 when it is inserted into bore 134 of sub 102 so that wiring conduit 155 is aligned with conduit 150 of feed-through 108. In some embodiments, this alignment may be maintained by set screws 164 (or other suitable fasteners), which may project radially inwardly through alignment apertures 163 (in feed-through 108) and into radially outwardly opening alignment recesses 162 (see FIG. 15B).

In the illustrated embodiment, transducer mounting features 159 are provided by first and second flanges 158, 160 of transducer holder 142. More particularly, first and second radially extending and axially facing surfaces 158A, 160A of first and second flanges 158, 160 hold the axial ends 505A, 505B of transducer assemblies 118. A friction or compression fit may be used to hold transducer assemblies 118 between axially facing flange surfaces 158A, 160A. In the illustrated embodiment of FIGS. 1 and 14, first flange surface 158A extends generally radially and faces generally toward second end 102B of sub 102 for a friction or compression fit to cap 510 at first axial end 505A of transducer assembly 118 and second flange surface 160A extends generally radially and faces generally toward first end 102A of sub 102 for a friction or compression fit to one or more of threaded members 504, 506 at second axial end 505B of transducer assembly 118. As shown in FIG. 1B a plurality (e.g. 12) of transducers assemblies 118 may be evenly azimuthally (e.g. circumferentially) distributed within transducer holder 142 about central axis 2.

The portion of radially outward surface 121 of transducer holder 142 that extends between first and second flange surfaces 158A, 160A may, in some embodiments, comprise a plurality of concavities or recesses 144 shaped for accommodating corresponding portions of corresponding transducer assemblies 118, as shown in FIGS. 1C and 14. In the illustrated embodiment of FIGS. 1, 14 and 15, concavities 144 extend axially between first and second flange surfaces 158A, 160A and open radially outwardly. In some embodiments, concavities (similar to concavities 144) may be provided on a radially inwardly facing surface of the transducer holder and could extend axially and open radially inwardly. Concavities 144 may be evenly azimuthally (e.g. circumferentially) distributed about central axis 2. Concavities 144 may be configured to provide additional space for transducer assemblies 118 to thereby minimize (to the extent possible) the likelihood of short circuits between transducer assemblies 118 and radially outward surface 121 of transducer holder 142. In one particular and non-limiting example, for a transducer assembly 118 with a diameter of 15 mm in a vicinity of piezoelectric transducer elements 516, the diameter of curvature of concavities 144 may be 16 mm. In some embodiments, insulating material (e.g. a high-temperature insulating film, such as Kapton™ manufactured by Dupont and/or the like) may be provided in concavities 144 and/or in any other spaces between radially outward surface 121 of transducer holder 142 and transducer assemblies 118 to provide additional electrical and/or thermal isolation and to minimize arcing.

In some embodiments, the first, second or both flanges 158, 160 of transducer holder 142 comprise slots (also referred to as recesses) 156 which are shown best in FIGS. 14 and 15. Slots 156 may comprise axially recessed slots shaped to receive axially extending protrusions 502 (also referred to as keys 502) of transducer assemblies 118. Slots 156 may be provided on axially facing surfaces 158A, 160A of flanges 158, 160 and may extend to the radially outward edges of flanges 158, 160. Slots 156 may receive axially extending protrusions 502 of transducer assemblies 118 and may thereby prevent rotation of particular components of transducer assemblies 118 about their respective axial axes. More particularly, protrusion 502 may be provided on the one of threaded members 504, 506 that is connected (via rod 512) to cap 510 or is otherwise connected to piezoelectric stack 530, such that these component to which protrusion 502 is connected are prevented from rotation when protrusion 502 extends axially into slot 156. Notably, however, the one of threaded members 504, 506 which does not include protrusion 502 is free to rotate. As described in further detail elsewhere in this disclosure, the cooperation of protrusions 502 of transducer assemblies 118 and slots 156 of transducer holder 142 to prevent rotation of one of threaded members 504, 506 about their respective axial axes may be used to pre-compress or pre-load transducer assemblies 118 to thereby cause transducer assemblies 118 to perform in a desired manner in response to electrical stimulation. In some embodiments, cap 510 may be provided with an axially extending protrusion for extension into a corresponding axially recessed slot on flange surface 158A. In some embodiments transducer assemblies 118 may be provided with slots and axially facing flange surfaces 158A, 160A may be provided with axially extending protrusions which provide similar functionality as protrusions 502 and slots 156 described herein.

Transducer assemblies 118 may be preloaded (or pre-compressed) to calibrate transducer assemblies 118 or to otherwise cause transducer assemblies 118 to behave in a desired manner in response to electrical stimulation. In general, pre-compression of transducer assemblies 118 may comprise pre-compression of piezoelectric transducer elements 516 in piezoelectric stack 530. In the FIG. 14 embodiment, pre-compression of a transducer assembly 118 may be achieved by mounting transducer assembly 118 between axial facing surfaces 158A, 160A of flanges 158, 160 of transducer holder 142 and then rotating threaded members 504, 506 relative to one another to move threaded members 504, 506 axially relative to one another and to thereby adjust the compression force applied to piezoelectric transducer elements 516 in piezoelectric stack 530. As discussed above, relative rotation of threaded members 504, 506 adjusts the axial length of transducer assemblies 118. However, when transducer assemblies 118 are connected between axial facing flange surface 158A, 160A, flanges 158, 160 are relatively rigid (as compared to transducer elements 516) and flanges 158, 160 do not deform substantially to accommodate any elongation of the axial dimension therebetween. Consequently, the forces associated with the relative rotation of threaded members 504, 506 and the axial movement of threaded members 504, 506 relative to one another manifest as compression of transducer elements 516 and/or piezoelectric stacks 530. Compressive force accumulates as the joined assembly of threaded members 504, 506 elongates due to their counter rotation and abuts against axial-facing surface 160A of flange 160, while cap 510 abuts against axial-facing surface 158A of flange 158.

The relative rotation of threaded members 504, 506 may be aided by the extension of protrusion 502 into slot 156 which may prevent rotational movement of one of threaded members 504, 506. In the illustrated embodiment, where male threaded member 504 comprises protrusion 502 which extends axially into slot 156, male threaded member 504 is prevented from rotation and female threaded member 506 can be rotated relative to male threaded member 504 using a suitable wrench, spanner or the like. In the illustrated embodiment, female threaded member 506 comprises faces (not expressly enumerated) to provide grip with a hexagonal wrench, spanner or the like to facilitate rotation of threaded member 506. Other alternate shapes and techniques for gripping one of threaded members 504, 506 may be provided in some embodiments.

As described above, the transducer assembly 118 is mechanically adjustable (e.g. by relative rotation of threaded members 504, 506) to exert preload pressure on piezoelectric transducer elements 516 of piezoelectric stack 530 and to thereby "tune" the response characteristics of transducer assembly 118 to applied electrical stimuli and/or to applied external forces. In the illustrated embodiment, piezoelectric transducer elements 516 which make up piezoelectric stack 530 of transducer assembly 118 are used to generate pressure waves in sub 102 which travel acoustically through connected drill string and/or pipe. By applying an electric field to piezoelectric transducer elements 516, the piezoelectric effect causes piezoelectric transducer elements 516 to expand, thus launching a pressure wave which travels longitudinally (e.g. axially) through the sub-pipe. Suitable modulation of the electric field can be used to communicate information through sub 102 and any connected drill string and/or pipe. In some embodiments, piezoelectric transducer elements 516 which make up stack 530' of transducer assembly 118' are used to receive pressure waves from sub 102 which travel acoustically through connected drill string and/or pipe. By applying external forces (e.g. acoustic or pressure-based forces) to transducer elements 516, the piezoelectric effect causes piezoelectric transducer elements 516 to generate corresponding electrical signals which may be suitably demodulated to extract data.

Figure 3:
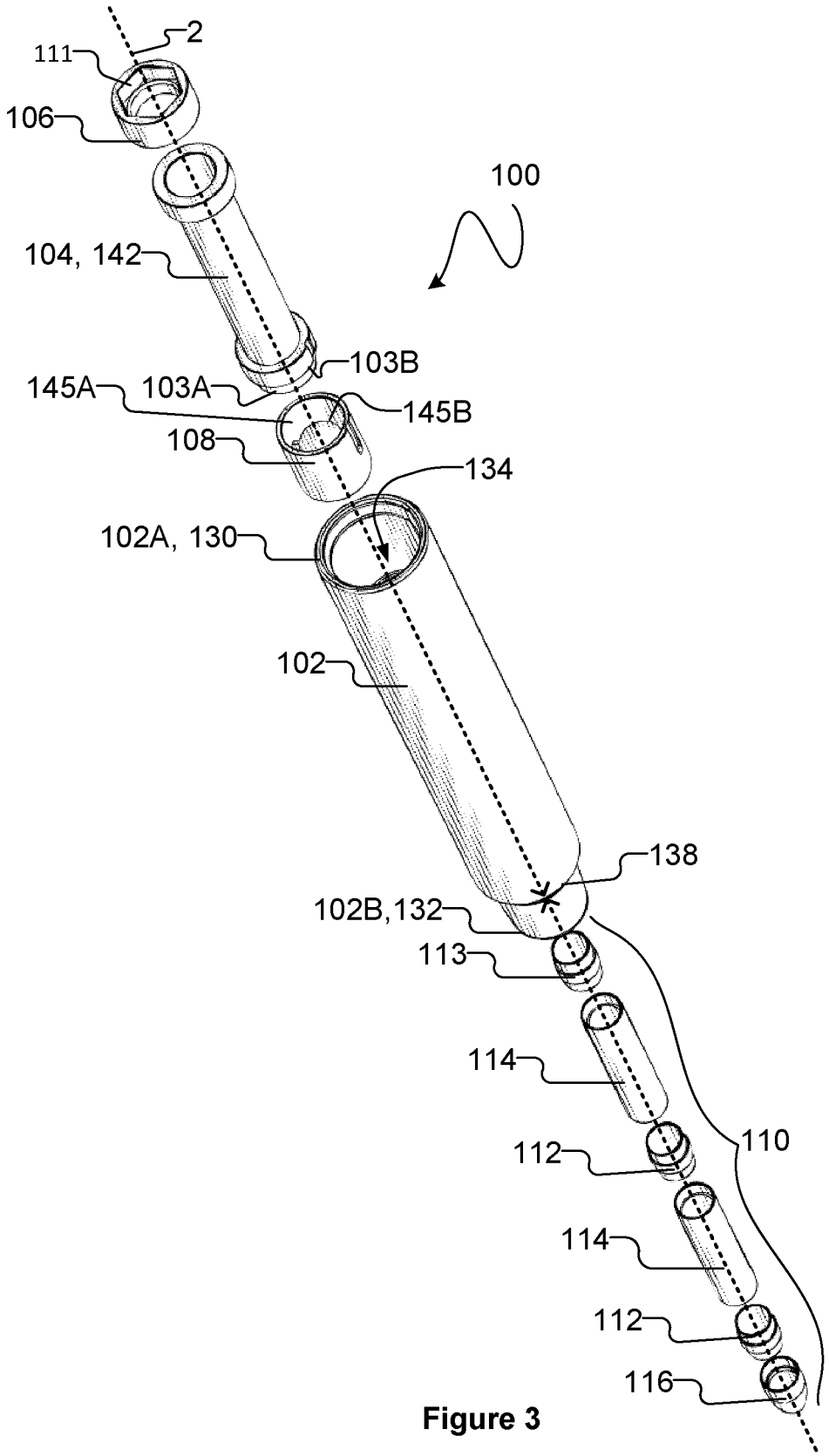
FIG. 3 is an exploded isometric view of the FIG. 1 apparatus for mounting transducers inside the bore of a sub-pipe with a number of features of a number of components and transducer-holding assemblies removed for clarity.
Figure 4:
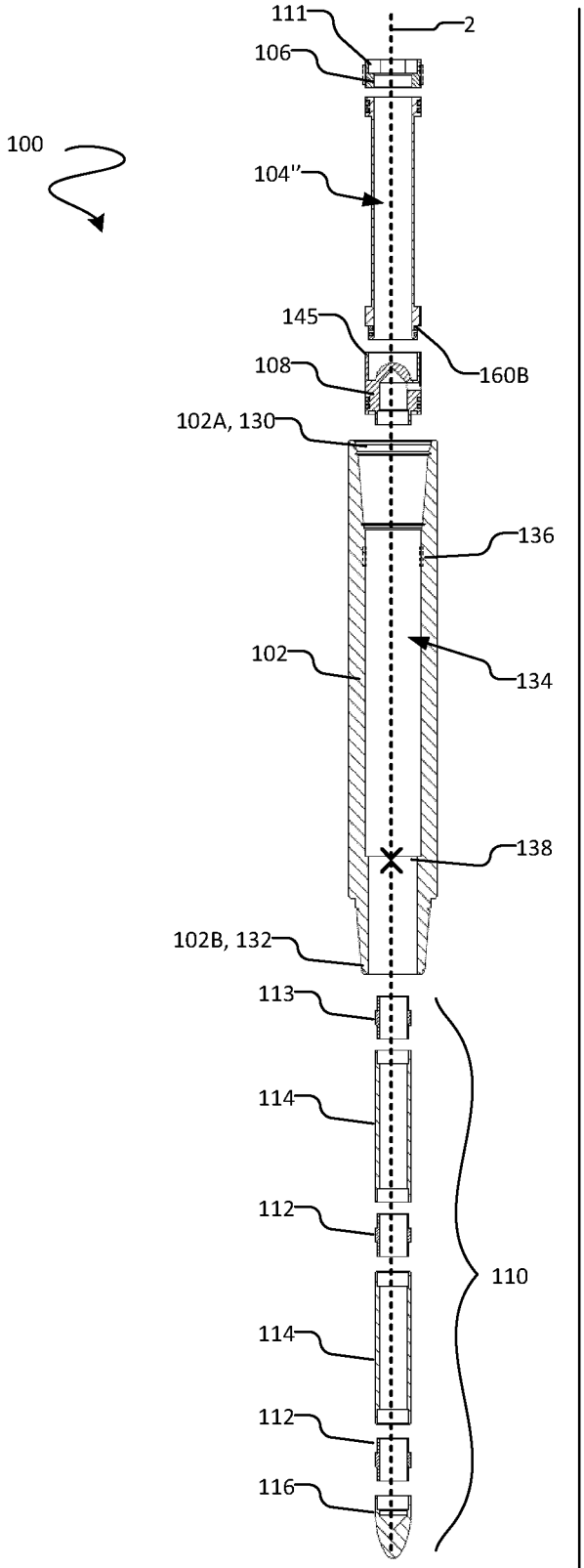
FIG. 4 is an exploded cross-sectional view of the FIG. 3 apparatus.

Referring to FIGS. 1D and 3, in some embodiments, apparatus 100 may comprise an electronics housing 110. Electronics housing 110 may comprise a connector component 113 for connection of electronics housing 110 to electronic connector 149 of feed-through 108. In addition to connector component 113, electronics housing 110 may comprise one or more electronics compartments 114, each of which may be configured for housing tools, sensors, batteries, communications hardware, suitable controllers, other electronics and/or the like. Electronics housing 110 may also comprise mechanical connectors 112 for connecting adjacent electronics compartments 114 and a tail cone 116.

Mechanical connectors 112 may provide connector joints for securely coupling adjacent electronic compartments 114 and/or for coupling an electronic compartment 114 to tail cone 116. In the illustrated embodiment, electronics housing 110 comprises a plurality of composite, pressure-sealed electronics compartments 114 connected to one another by mechanical connectors 112. In the FIG. 1D embodiment, electronics and battery(s) (e.g. tools, sensors, batteries, communications hardware, suitable controllers, other electronics and/or the like) are housed within electronics compartments 114 of electronics housing 110. To the extent that such components are located in different electronics compartments 114, such components may be connected through suitable electrical connectors (e.g. by Amphenol and/or the like) within electronics housing 110 that pass between electronics compartments 114. In some particular and non-limiting embodiments, circuit boards may be mounted on strongbacks, encapsulated with a high temperature potting compound such as Sylgard™, placed inside pressure-sealed electronics compartments 114 within electronics housing 110 and sealed with O-rings (not shown) for protection against the pressure, corrosion and abrasion of drilling fluid.

With the use of mechanical connectors 112, any suitable number of electronics compartments can be provided as part of electronics housing 110. Depending on the length of electronics housing 110, in some embodiments, electronics housing 110 may be further axially centered by means of additional fins (not shown) within sub 102 and/or within an adjacent pipe stand or pipe (not shown) connected to pin end 102B of sub 102. The length of electronics housing 110 may depend in part on the number, type and amount of tools, sensors, batteries, communications hardware, suitable controllers, other electronics and/or the like housed within electronics housing 110 and the length of the circuit boards used to implement these components.

In particular embodiments, electronics housing 110 may be pre-assembled as a single unit and at least partially inserted bore 134 of sub 102 from second axial end 102A until connector component 113 of electronics housing 110 is operatively connected to electronics connector 149 of feed-through 108. The connection between connector component 113 of electronics housing 110 and electronics connector 149 of feed-through may comprise a threaded connection (not expressly shown). In further particular embodiments, electronics housing 110 may be pre-assembled and operatively connected to electronics connector 149 of feed-through 108 to provide electronics housing 110 and feed-through 108 as a single unit. The combined feed-through 108 and electronics housing 110 may be inserted into bore 134 of sub 102 from the first axial end 102A until feed-through 108 abuts arrest 138. In some further particular embodiments, transducer-holding assembly 104, feed-through 108 and electronics housing 110 may be pre-assembled as a single unit prior to being inserted into bore 134 of sub 102 from the first axial end 102A.

Figure 5:
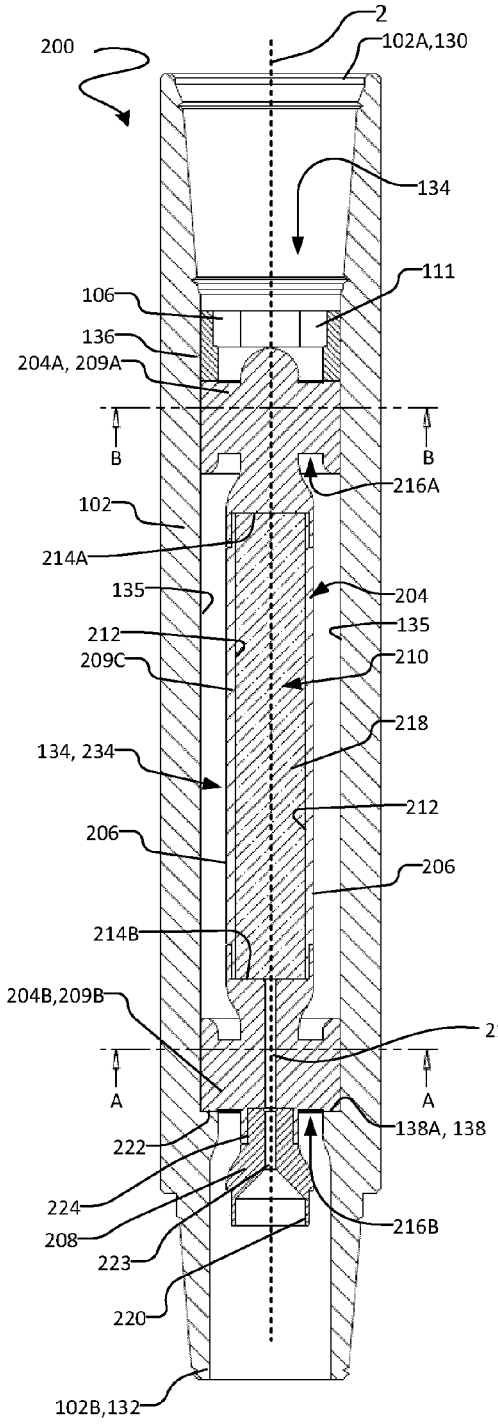
FIG. 5 is a cross-sectional view of an apparatus for mounting transducers inside the bore of a sub-pipe in accordance with a particular embodiment.
Figure 5B:
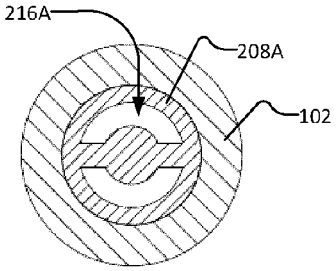
FIG. 5B is a sectional view of the FIG. 5 apparatus at B-B.
Figure 5A:
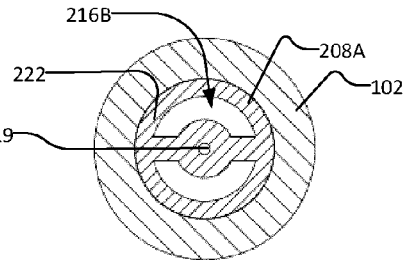
FIG. 5A is a sectional view of the FIG. 5 apparatus at A-A.
Figure 5C:
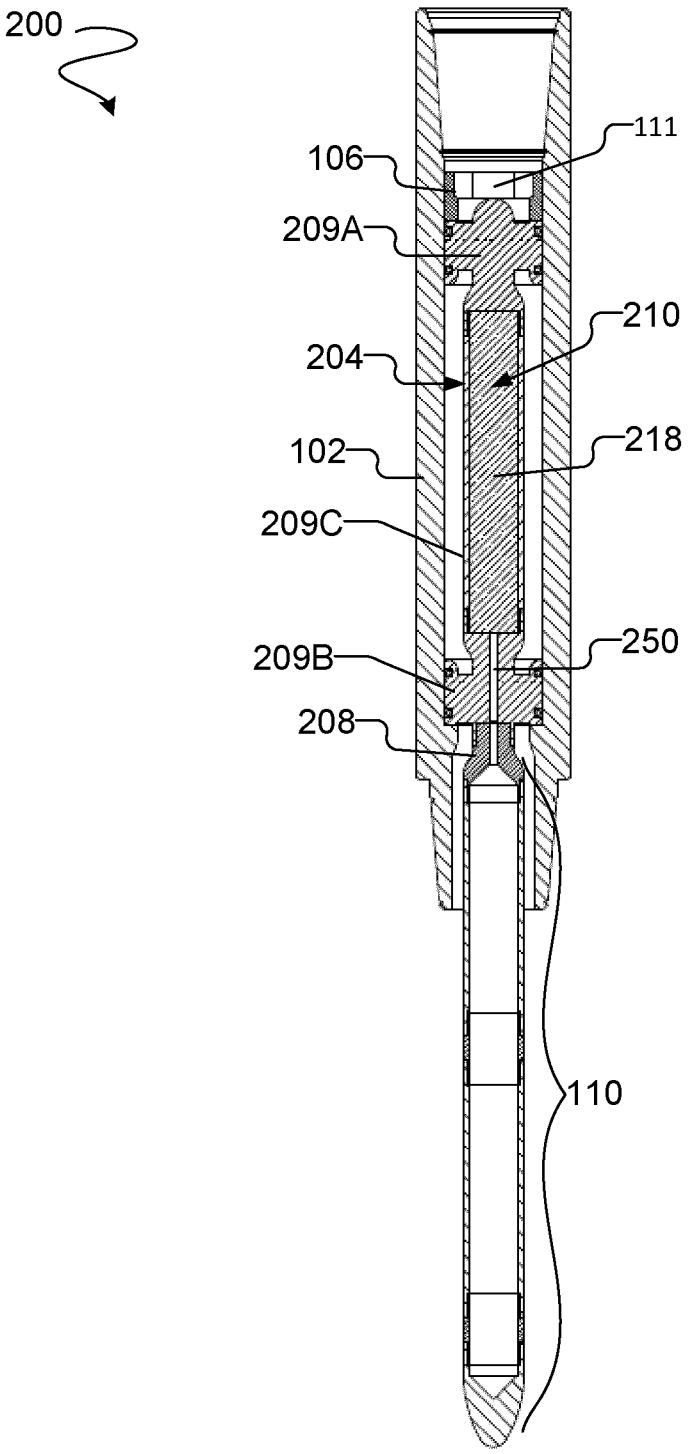
FIG. 5C is a cross-sectional view of the FIG. 5 apparatus with an electronics housing connected thereto.

FIGS. 5, 5A and 5B (collectively, FIG. 5) show various views of an apparatus 200 for mounting transducers to a sub 102 according to another particular embodiment. Apparatus 200 of the FIG. 5 embodiment comprises a sub 102, a tension collar 106 and an optional electronics housing 110 which may be substantially similar to those of the FIG. 1 embodiment (apparatus 100) described elsewhere in this disclosure. Apparatus 200 of FIG. 5 differs from apparatus 100 of FIG. 1 primarily in that apparatus 200 comprises a transducer-holding assembly 204 which, when mounted in bore 134 of sub 102, permits the location of one or more transducer assembly(s) 218 at a radially inward location(s) relatively close to central axis 2 and permits the flow of drilling fluid through apparatus 200 through a channel 234 located radially outwardly of transducer assemblies 218 (e.g. between a radial outward surface 206 of transducer-holding assembly 204 and bore-defining surface 135 of sub 102). Feed-through 208 of the FIG. 5 embodiment is also different from feed through 108 of the FIG. 1 embodiment.

Transducer-holding assembly 204 of the FIG. 5 embodiment comprises a multi-part transducer holder 209 comprising a first axial end component 209A at first axial end 204A of transducer-holding assembly 204, a second axial end component 209B at opposing second axial end 204B of transducer-holding assembly 204 and a central component 209C located between axial end components 209A, 209B. Together, components 209A, 209B, 209C of transducer holder 209 define a cavity 210 for housing one or more transducer assembly(s) 218. More particularly, central component 209C comprises a bore defining surface 212 which defines the radial extent of cavity 210 and central component 209C connects to each of axial end components 209A, 209B which respectively comprise axial-facing surfaces 214A, 214B which define the axial extent of cavity 210. Central component 209C may comprise male threads at each of its axial ends for connecting to corresponding female threads of axial end components 209A, 209B. These threads are not explicitly shown in FIG. 5. Central component 209C may be called barrel housing. Further, the male and female threads may be reversed in some embodiments. In some embodiments, other techniques (e.g. pressure fits with O-ring seals and/or the like) may be used to connect central component 209C to axial end components 209A, 209B. Axial end components 209A, 209B each provide channels 216A, 216B which extend axially therethrough for permitting the flow of drilling fluid through apparatus 200. Axial end component 209B also comprises an axially extending conduit 219 through which electronic leads (e.g. wires) may extend to connect electronics housed in electronics housing 110, through feed-through 208, to transducer assembly(s) 218.

Feed-through 208 of the FIG. 5 embodiment differs from feed-through 108 of the FIG. 1 embodiment in that some of the functions and features of feed-through 108 are implemented by axial end component 209B in the FIG. 5 embodiment. In particular, feed-through 208 comprises an electronics connector 220 that is similar to electronics connector 149 of feed-through 108 described elsewhere herein and connects to electronics housing 110 to locate electronics housing 110 radially close to (or co-axial with) central axis 2. Feed through 208 also comprises a conduit 223 which is axially aligned with conduit 219 for routing electronic leads (e.g. wires) to connect electronics housed in electronics housing 110, through feed-through 208 (via conduit 223), through axial end component 209B (via conduit 219) and to transducer assembly(s) 218. Feed-through 208 may connect rigidly to axial end component 209B (e.g. prior to insertion of transducer-holding assembly 204 into bore 134). Feed-through 208 may comprise male threads for connecting to corresponding female threads of axial end component 209B at connection 224. These threads of connection 224 are not explicitly shown in FIG. 5. Further, the male and female threads may be reversed in some embodiments. In some embodiments, other techniques (e.g. pressure fits with O-ring seals and/or the like) may be used to connect axial end component 209B to feed-through 208.

In the illustrated embodiment, axial end component 209B is inserted into bore 134 through first axial end 102A of sub 102 and abuts (e.g. bears) against arrest 138. Arrest 138 may be substantially similar to arrest 138 described elsewhere in this disclosure. Axial end component 209B may comprise an axial-facing bearing surface 222 which is similar to surface 151A of feed-through 108 for bearing against a complementary axial-facing surface 138A of arrest 138. Where arrest 138 is threaded, axial end component 209B may be modified for connection to a threaded arrest 138. In some embodiments, the threads of connection 224 of axial end component 209B may be configured for direct connection of axial end component 209B to electronics housing 110, in which case there is no need for a separate feed-through 208 and feed-through 208 may be omitted. In such embodiments, transducer-holding assembly 204 may be said to comprise a feed-through portion which may connect to electronics housing 110 and bear against arrest 138.

Apparatus 200 comprises a tension collar 106 which is substantially similar to tension collar 106 of the FIG. 1 embodiment. Connector component 107 of tension collar 106 may be connected to complementary connector component 136 on bore-defining surface 135 of sub 102 to permit axial adjustment of tension collar 106 relative to sub 102. In the particular case of the illustrated embodiment, connector components 107, 136 comprise threads, such that tension collar 106 may be rotated to adjust the axial position of tension collar 106 relative to sub 102. In the FIG. 5 embodiment, tension collar 106 bears against first axial end component 209A of transducer-holding assembly 204. In a manner similar to that discussed above, suitable rotation of tension collar 206 may be used to control the axial forces by which tension collar 106 bears on first axial end component 209A of transducer-holding assembly 204, the axial forces by which transducer-holding assembly 204 (in particular second axial end component 209B) bears against arrest 138 and/or the corresponding compressive forces by which transducer-holding assembly 204 is axially compressed between tension collar 106 and arrest 138. Through these abutting and/or threaded connections, transducer-holding assembly 204 (via tension collar 106) may be mounted in the bore 134 of sub 102 in a compressed state and in intimate contact for acoustic coupling with sub 102 and corresponding acoustic communication between transducer-holding assembly 204 and sub 102 any connected drill string and/or pipe.

Transducer-holding assembly 204 of the FIG. 5 embodiment comprises one or more transducer assembly(s) 218 which are operatively located in cavity 210. Although FIG. 5 does not expressly provide any detail of transducer assembly(s) 218, each of transducer assembly(s) 218 may be substantially similar to transducer assembly 118 described elsewhere in this disclosure. In some embodiments, axial-facing surfaces 214A, 214B of first and second axial end components 209A, 209B may be shaped to provide features and/or functionality similar to that of axial facing surfaces 158A, 160A of flanges 158, 160 described elsewhere in this disclosure. In this regard, axial-facing surfaces 214A, 214B may be considered to and/or referred to as flange surfaces. In other embodiments, different components (not shown) may be provided with features and/or functionality similar to that of axial facing surfaces 158A, 160A. In some embodiments, air gaps in cavity 210 (e.g. between transducer assembly(s) 218 central component 209C) may be filled with a high temperature potting compounding such as Sylgard™ (manufactured by Dow Corning) and/or the like.

Figure 16:
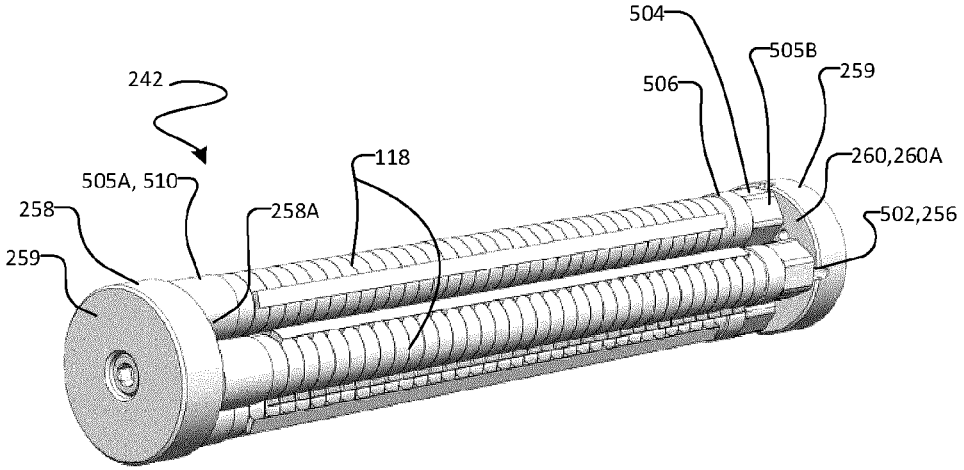
FIG. 16 is an isometric view of a transducer holder holding a number of transducer assemblies suitable for use with the apparatus of FIG. 5 in accordance with a particular embodiment.
Figure 16A:
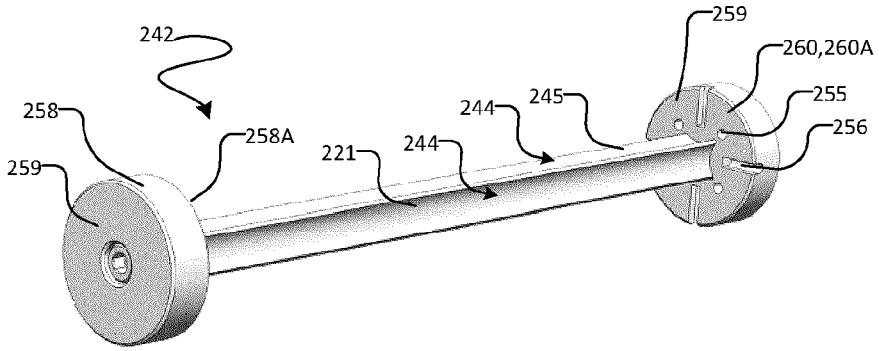
FIG. 16A is an isometric view of the FIG. 16 transducer holder with the transducer assemblies removed for clarity.
Figure 16B:
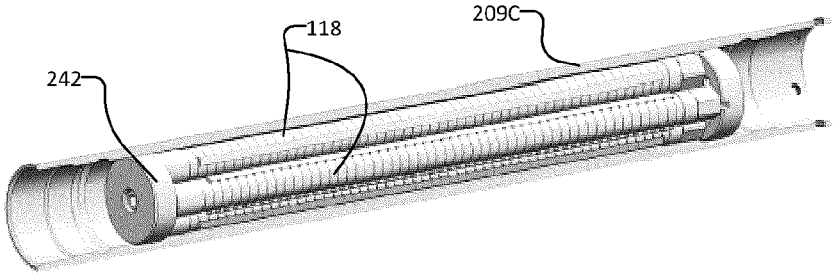
FIG. 16B is a partially cut-away isometric view of the FIG. 16 transducer holder holding a number of transducer assembles within a cross-sectioned central component.

FIG. 16 depicts transducer holder 242 which is holding a plurality of transducer assemblies 118 according to a particular embodiment. FIG. 16A shows the FIG. 16 transducer holder 242 with transducer assemblies 118 removed for clarity. Transducer holder 242 of the FIG. 16 embodiment is suitable for use with apparatus 200 of FIG. 5 and, in some embodiments, may comprise a sub-component of transducer holder assembly 204 and/or transducer holder 209 of apparatus 200. In particular, transducer holder 242 of FIGS. 16 and 16A may be located in cavity 210 defined by axial end components 209A, 209B and central component 209C. Transducer assemblies 118 shown in FIG. 16 may be substantially similar to transducer assemblies 118 described elsewhere in this disclosure. FIG. 16B depicts the transducer holder 242 which is holding a plurality of transducer assemblies 118 housed within a partially cut-away central component (barrel housing) 209C.

Transducer holder 242 of the FIG. 16 embodiment comprises many features that are similar to those of transducer holder 142 described elsewhere in this disclosure. In particular, transducer holder 242 comprises one or more transducer mounting features 259 for mounting transducer assemblies 118 to transducer holder 242, one or more wiring channels 255 for passing electrical leads (e.g. wires) that connect transducer assemblies 118 mounted in transducer holder 242 to electronics housed in electronics housing 110 (e.g. via conduits 219, 223 of axial end component 209B and feed-through 208. In the FIG. 16 embodiment, transducer mounting features 259 are provided by first and second flanges 258, 260 of transducer holder 242. More particularly, first and second radially extending and axially facing surfaces 258A, 260A of first and second flanges 258, 260 hold axial ends 505A, 505B of transducer assemblies 118. Flanges 258, 260 and their corresponding axial facing flange surfaces 258A, 260A may comprise characteristics, features and/or variations similar to those of flanges 158, 160 and axial-facing flange surfaces 158, 160 described elsewhere herein and may provide functionality that is substantially similar to flanges 158, 160 and axial-facing flange surfaces 158, 160 described elsewhere herein.

The portion of radially outward surface 221 of transducer holder 242 that extends between first and second flange surfaces 258A, 260A may, in some embodiments, comprise a plurality of concavities or recesses 244 shaped for accommodating corresponding portions of corresponding transducer assemblies 118, as shown in FIGS. 16 and 16A. Concavities 244 may comprise characteristics, features and/or variations similar to those of concavities 144 described elsewhere herein and may provide functionality that is substantially similar to concavities 144 described elsewhere herein. In some embodiments, insulating material (e.g. a high-temperature insulating film, such as Kapton™ manufactured by Dupont and/or the like) may be provided in concavities 244 and/or in any other spaces between radially outward surface 221 of transducer holder 242 and transducer assemblies 118 to provide additional electrical and/or thermal isolation and to minimize arcing.

In some embodiments, the first, second or both flanges 158, 160 of transducer holder 142 comprise slots (also referred to as recesses) 256 which are shown best in FIG. 16A. Slots 256 may comprise characteristics, features and/or variations similar to those of slots 156 described elsewhere herein and may provide functionality that is substantially similar to slots 156 described elsewhere herein. In particular, the combination of axially extending protrusions 502 on transducer assemblies 118 and axially recessed slots 256 on one or more of axial facing surfaces 258A, 260A (or vice versa) may be used to pre-load transducer assemblies 118

Transducer holder 242 (together with transducer assemblies 118) may be shaped to be insertable within cavity 210 of transducer-holding assembly 204 of apparatus 200 of the FIG. 5 embodiment. Referring now to FIG. 5, when transducer holder 242 is housed in cavity 210, axial facing surfaces 214A, 214B of axial end components 209A, 209B may bear against flanges 258, 260. The screw connections between axial end components 209A, 209B and central component 209C may be used to control the bearing forces as between axial facing surfaces 214A, 214B and flanges 258, 260 to facilitate acoustic communication between transducer assemblies 118 and flanges 258, 260, to axial end components 209A, 209B, to sub 102 and to any connected drill string or pipe. In some embodiments, air-gaps in cavity 210 may be filled with a high temperature potting compounding such as Sylgard™ (manufactured by Dow Corning) and/or the like.

Transducer holder 242 comprises wire conduits 255 as described above, which may provide passages for wire from axial end cap 209B to transducer assemblies 118. In some embodiments, one or more wire conduits (not shown) may be provided from flange 260 at one axial end of transducer holder 242 to flange 258 at the opposing axial end of transducer holder 242 (e.g. through central member 245). Such conduits may also extend radially outwardly along flanges 258, 260 providing wire access to both axial ends of the transducer assemblies 118.

Figure 6:
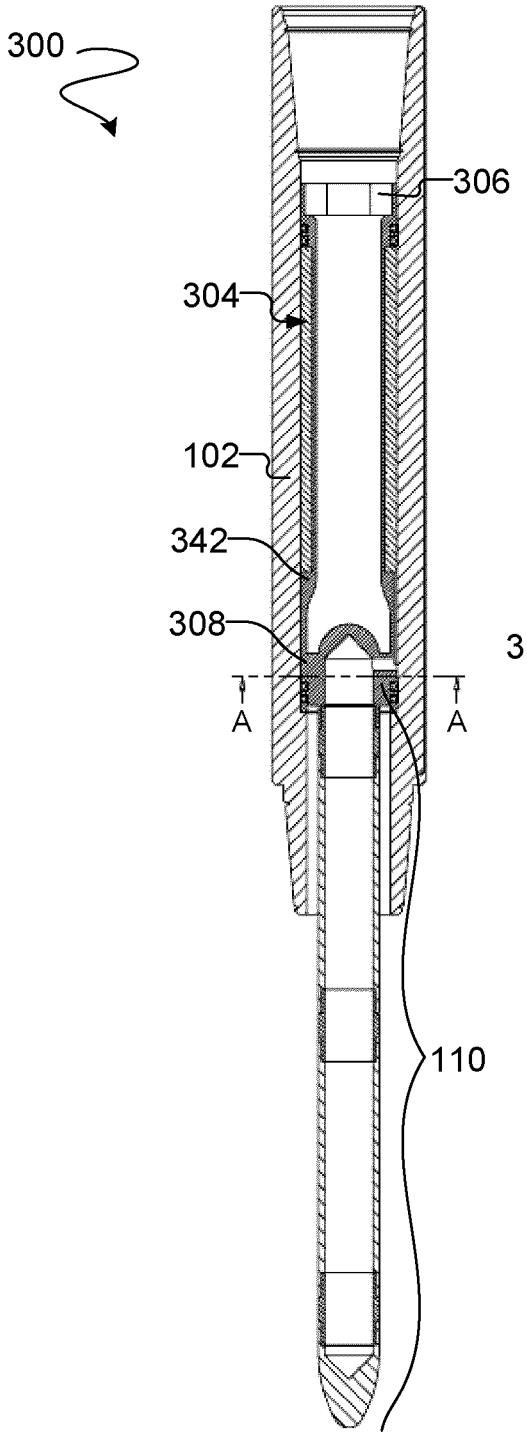
FIG. 6 is a cross-sectional view of an apparatus for mounting transducers inside the bore of a sub-pipe according to a particular embodiment.
Figure 6A:
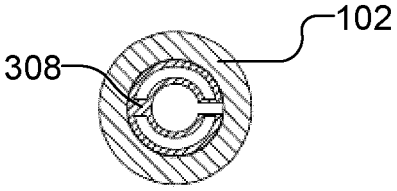
FIG. 6A is a sectional view of the FIG. 6 apparatus at A-A.

FIGS. 6 and 6A (collectively, FIG. 6) show various views of an apparatus 300 for mounting transducers to a sub 102 according to another particular embodiment. Apparatus 300 of the FIG. 6 embodiment comprises a sub 102 and an optional electronics housing 110 which may be substantially similar to those of the FIG. 1 embodiment (apparatus 100) described elsewhere in this disclosure. Apparatus 300 of FIG. 6 differs from apparatus 100 of FIG. 1 primarily in that apparatus 300 comprises a transducer-holding assembly 304 with an integral feed-through portion 308 and an integral tension collar portion 306. In particular, feed-through portion 308 and tension collar portion 306 may be integral with transducer holder 342 of transducer-holding assembly 304. It is not necessary that feed-through portion 308 and/or tension collar portion 306 be integrally fabricated with transducer-holding assembly 304. These portions (e.g. feed-through portion 308 and/or tension collar portion 306) may be independently fabricated and then joined (e.g. by suitable welding or the like) to form integral portions of transducer-holding assembly 304.

With the exception of the contact/bearing of feed-through 108 against transducer-holding assembly 104, feed-through portion 308 of transducer-holding assembly 304 may comprise characteristics, features and/or variations similar to those of feed-through 108 of the FIG. 1 embodiment and may provide functionality that is substantially similar to feed-through 108 of the FIG. 1 embodiment. It will be appreciated that features of contact of bearing between feed-through 108 and transducer-holding assembly 104 are not application where feed-through portion 308 is integrally formed with transducer-holding assembly 304. Similarly, with the exception of the contact/bearing of tension collar 106 against transducer-holding assembly 104, tension collar portion 306 of transducer-holding assembly 304 may comprise characteristics, features and/or variations similar to those of tension collar 106 of the FIG. 1 embodiment and may provide functionality that is substantially similar to tension collar 106 of the FIG. 1 embodiment. It will be appreciated that features of contact of bearing between tension collar 106 and transducer-holding assembly 104 are not application where tension collar portion 306 is integrally formed with transducer-holding assembly 304.

In some embodiments, only one of feed-through portion 308 and tension collar portion 306 is integral with transducer-holding assembly 304 and the other one of feed-through portion 308 and tension collar portion 306 is provided as a separate feed-through 108 or tension collar 106 in a manner similar to that of the FIG. 1 embodiment.

Figures 8, 8A:
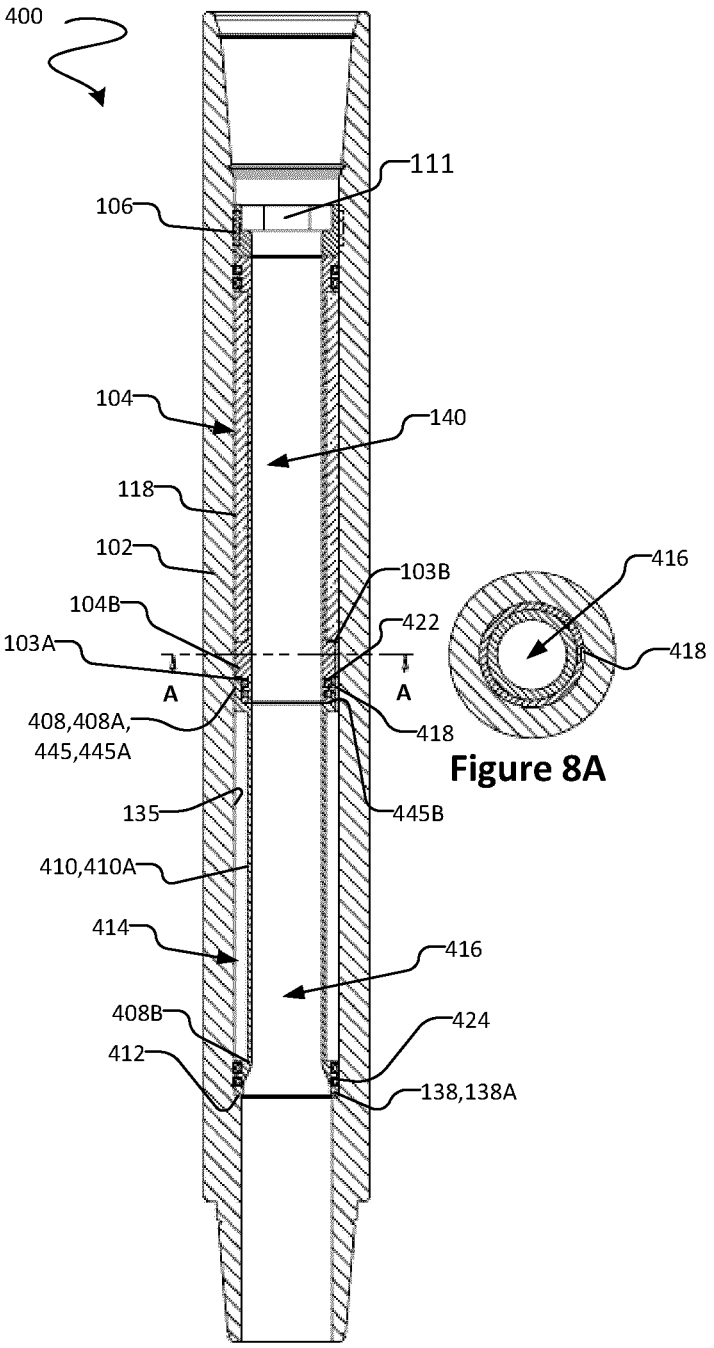
FIG. 8 is a cross-sectional view of an apparatus for mounting transducers inside the bore of a sub-pipe in accordance with a particular embodiment.
FIG. 8A is a sectional view of the FIG. 8 apparatus at A-A.

FIGS. 8 and 8A (collectively, FIG. 8) shows various views of an apparatus 400 for mounting transducers to a sub 102 according to another particular embodiment. Apparatus 400 of the FIG. 8 embodiment comprises a sub 102, a tension collar 106 and a transducer-holding assembly 104 which may be substantially similar to those of the FIG. 1 embodiment (apparatus 100) described elsewhere in this disclosure. Apparatus 400 of FIG. 8 differs from apparatus 100 of FIG. 1 primarily in that apparatus 400 comprises a feed-through 408 which comprises an electronics mandrel 410. Electronics mandrel 410 of feed-through 408, together with bore-defining surface 135 of sub 102, provides an electronics housing 414 located between a radial outward facing surface 410A of electronics mandrel 410 and radially inward facing bore-defining surface 135. Electronics housing 414 may provide the functionality of electronics housing 110 of the FIG. 1 embodiment. In particular, electronics housing 414 may house tools, sensors, batteries, communications hardware, suitable controllers, other electronics and/or the like. Feed-through 408 may comprise a conduit 418 through which electrical leads (e.g. wires) may extend between the various components in electronics housing 414 and transducer assemblies 118 held by transducer-holding assembly 104. Feed-through 408 may also comprise a bore 416 which is in communication with bore 140 to permit the flow of drilling fluid through apparatus 400 and sub 102.

In other respects, feed-through 408 may be generally similar to feed-through 108 described above. For example, feed-through 408 may comprise a first axial end 408A which contacts and bears against second axial end 104B of transducer-holding assembly 104 in much the same manner as the contact between transducer-holding assembly 104 and feed-through 108 described above. In the particular case of the illustrated embodiment, first axial end 408A of feed-through 408 may comprise a transducer-holding assembly engaging portion 445 comprising a recessed surface 445A and a shoulder 445B which are similar to recessed surface 145A and shoulder 145B described elsewhere in this disclosure for engaging with corresponding recessed surface 103A and shoulder 103B of the second axial end 104B of transducer-holding assembly 104. With these components, first axial end 408A of feed-through 408 contacts and bears against second axial end 104B of transducer-holding assembly 104. O-rings 422 similar to O-rings 122 may be provided between engaging surfaces of first end 408A of feed-through 408 and second end 140B of transducer-holding assembly 104. Feed-through 408 may also comprise a second end 408B which bears against arrest 138. More particularly, second end 408B of feed-through 408 may comprise an axial facing surface 412 which bears against axial facing surface 138A of arrest 138. Where arrest 138 comprises a threaded arrest, then second end 408B of feed-through 408 may be modified to provide suitable threads. O-rings 424 similar to O-rings 124 may be provided between engaging surfaces of second end 408B of feed-through 408 and bore-defining surface 135 of sub 102.

In some embodiments, a notch in electronics feed-through 408 and a corresponding key in transducer-holding assembly 104 may provide rotational alignment between feed-through 408 and transducer-holding assembly 104. In some embodiments, tension collar 106 may be integral with transducer-holding assembly 104 to provide a tension collar portion of transducer-holding assembly 104. Such a tension collar portion could comprise features and provide functionality similar to that of tension collar 106, except where tension collar 106 contacts and bears against transducer-holding assembly 104. In some embodiments, feed-through 408 may be integral with transducer-holding assembly 104 to provide a feed-through portion of transducer-holding assembly 104. Such a feed-through portion could comprise features and provide functionality similar to that of feed-through 408, except where feed-through 408 contacts and bears against transducer-holding assembly 104.

Figures 9, 9A:
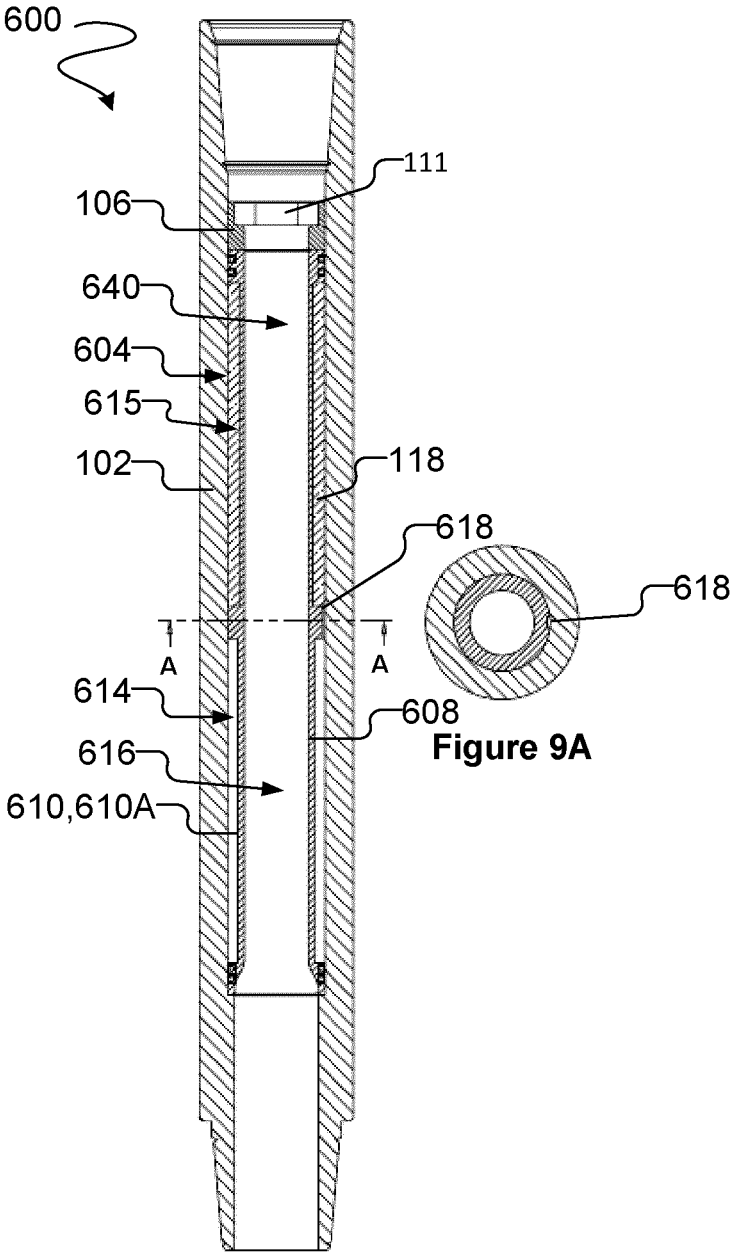
FIG. 9 is a cross-sectional view of an apparatus for mounting transducers inside the bore of a sub-pipe in accordance with a particular embodiment.
FIG. 9A is a sectional view of the FIG. 9 apparatus at A-A.

FIGS. 9 and 9A (collectively, FIG. 9) shows various views of an apparatus 600 for mounting transducers to a sub 102 according to another particular embodiment. Apparatus 600 of the FIG. 9 embodiment comprises a sub 102 and a tension collar 106 which may be substantially similar to those of the FIG. 1 embodiment (apparatus 100) described elsewhere in this disclosure. Apparatus 600 of FIG. 9 is similar in many respects to apparatus 400 of FIG. 8, except that apparatus 600 comprises a transducer-holding assembly 604 which comprises an integral feed-through portion 608. Transducer-holding assembly 604 comprises features of provides functionality substantially similar to transducer-holding assembly 104 of the FIG. 8 apparatus 400 (and the FIG. 1 apparatus 100), except where transducer-holding assembly 104 of apparatus 400 contacts and bears against feed-through 408. In particular, transducer-holding assembly 604 may hold transducer assemblies 118 in cavity 615 (which may be similar to cavity 115 described above).

Similarly, feed-through portion 608 comprises features and provides functionality substantially similar to feed-through 408 of the FIG. 8 apparatus 400, except where feed-through 408 of apparatus 400 contacts and bears against transducer-holding assembly 104. In particular, feed-through portion 608 may comprise an electronics mandrel 610. Electronics mandrel 610 of feed-through portion 608, together with bore-defining surface 135 of sub 102, provides an electronics housing 614 located between a radial outward facing surface 610A of electronics mandrel 610 and radially inward facing bore-defining surface 135. Electronics housing 614 may house tools, sensors, batteries, communications hardware, suitable controllers, other electronics and/or the like. Feed-through portion 608 may comprise a conduit 618 through which electrical leads (e.g. wires) may extend between the various components in electronics housing 614 and transducer assemblies 118 held by transducer-holding assembly 604 in cavity 615. Feed-through 608 may also comprise a bore 616 which is in communication with bore 640 of transducer-holding assembly 604 to permit the flow of drilling fluid through apparatus 600 and sub 102. In other respects, apparatus 600 may be similar to apparatus 400.

Figure 7:
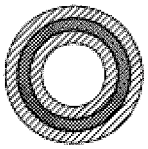
FIG. 7 depicts various circumferential views of non-limiting transducer-holding assembly embodiments and feed-through configurations.
Figure 7:
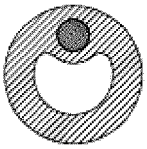
Figure 7:
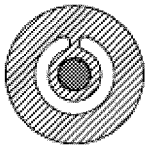
Figure 7:
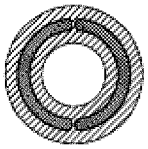
Figure 7:
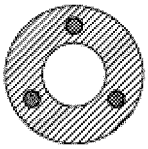
Figure 7:
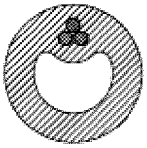
Figure 7:
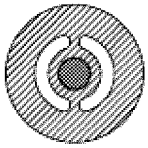
Figure 7:
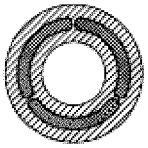
Figure 7:
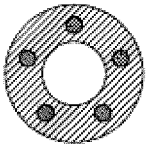
Figure 7:
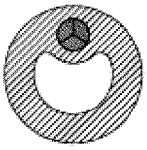
Figure 7:
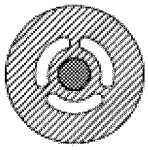
Figure 7:
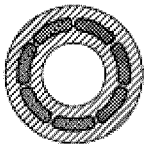
Figure 7:
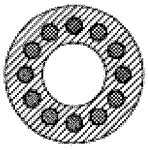
Figure 7:
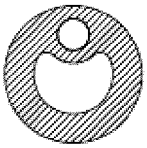
Figure 7:
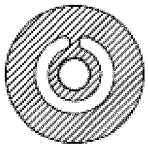
Figure 7:
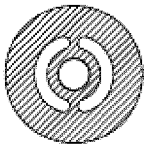
Figure 7:
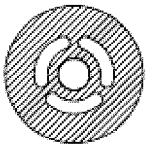

FIG. 7 shows a number of transducer-holding assembly cross-sections and feed-through cross-sections which may be used in some non-limiting embodiments. FIGS. 7.1B-7.1D depict transducer-holding assemblies with off-centered transducer compartments and a shunting channel for drilling fluid. FIGS. 7.2B-7.2D depict transducer-holding assemblies with centered transducer compartments and various configurations of shunting channels for drilling fluid. FIGS. 7.3B-7.3E depict transducer-holding assemblies with annular transducer compartments and a central channel (co-axial with central axis 2) for drilling fluid. FIGS. 7.4 B-7.4D depict transducer-holding assemblies with evenly azimuthally (e.g. circumferentially) distributed transducer compartments around a central channel for drilling fluid. FIGS. 7.1A-7.4A depict various non-limiting embodiments of feed-through configurations for use with corresponding transducer-holding assembly configurations.

The outer diameter of sub 102, as shown in FIGS. 1-9, may match the collar diameter of the drill string pipe stands (e.g. at 6.5 in [about 16.5 cm], or 4.75 in [about 12.1 cm] in some embodiments). In one particular and non-limiting embodiment, as shown in FIGS. 10C and 10D, sub 102' has an outer diameter of 6.5 in (about 16.5 cm) with a wall thickness of 0.75 in (about 1.9 cm), the transducer-holding assembly has an outer diameter of 4 in (about 10 cm), and has centrally within it a channel with diameter 2.25 in (about 5.7 cm) for drilling fluid. In another particular and non-limiting embodiment, as shown in FIGS. 10A and 10B, sub 102 has a wall thickness of 1.25 in (about 3.2 cm) to provide more mechanical tensile and torsional strength.

As discussed above, the various embodiments described herein mount transducers in sub 102 such that there is intimate (e.g. acoustic) contact between transducers and sub 102 such that pressure waves created by transducers are transmitted to sub 102 and through sub 102 to any connected drill string and/or pipe. In particular embodiments, sensors within the electronics housing (e.g. electronics housing 110) collect information about various operational parameters of the drill string. Communication electronics within the electronics housing encode the sensor information within waves that may be generated by transducer assemblies 118 (e.g. actuators). Electrical signals may be transmitted from the electronics housing 110 via wires through suitable conduits to transducer assemblies 118 and cause transducer assemblies 118 to expand and contract thereby creating mechanical vibrations. The transducer-holding assemblies, which are acoustically coupled to sub 102, transfer these mechanical vibrations through sub 102 and along the drill string (not shown) to which sub 102 is attached. Transducers may additionally or alternatively be mounted in acoustic contact with sub 102 for receiving acoustic signals from sub 102 and generating corresponding electrical signals. For example, in particular embodiments, transducer assemblies 118' may generate electrical signals in response to acoustic signals received from sub 102 (e.g. from a connected pipe string) and such electrical signals may be transmitted to electronics housing 110 where data may be extracted by suitable receive circuitry.

In the various embodiments described herein, transducer assemblies 118 may be preloaded as described above and may be in intimate (e.g. abutting) contact with their corresponding transducer-holding assemblies for acoustic coupling of transducer assemblies 118 to transducer-holding assemblies. Transducer assemblies 118 are responsive to electrical stimulation. Each preloaded transducer assembly 118 may be used to generate mechanical vibrations based on corresponding electrical signals. When transducer assemblies 118 are actuated in this manner, they may acoustically transmit signals along sub 102 and along the drill string to which sub 102 is coupled. In some embodiments, such acoustic transmission can occur from a transmitter located at a downhole location in the drill string (e.g. at or near a drill head) to a receiver located at an uphole location. Data transmitted from the downhole transmitter to the uphole receiver may include, for example, data from MWD sensors and other tools.

Transducer assemblies 118' are responsive to acoustic stimulation. Each preloaded transducer assembly 118' may be used to generate an electrical signal based on corresponding acoustic signals received via sub 102 and any drill string coupled to sub 102. In some embodiments, such acoustic reception can occur at a receiver located at a downhole location in the drill string (e.g. at or near a drill head) from a transmitter located at an uphole location. Data received at the downhole receiver may include, for example, control and/or configuration information relating to the operation of MWD sensors and other tools deployed at or near the downhole location.

In embodiments described herein, transducer assemblies 118, 118' may be operatively (e.g. acoustically) mounted to sub 102 and may be used to transmit acoustic signals and/or receive acoustic signals. In some embodiments, separate transducer holding assemblies 104 may be provided for transmit functionality and receive functionality. Each such transducer-holding assembly 104 may comprise only transducer assemblies 118 configured for transmission or only receive-configured transducer assemblies 118'. This is not necessary. In some embodiments, a single transducer-holding assembly 1045 may comprise a number of transducer assemblies 118 configured for transmission and a number of receive-configured transducer assemblies 118'. In such a configuration, a single transducer-holding assembly 104 may be used to both transmit and receive acoustic signals. It will be appreciated by those skilled in the art that the transmit and receive configurations transducer assemblies 118, 118' shown in FIGS. 17A and 17B are not exhaustive. With suitable use of electrical insulators located between transducer elements 516, suitable wiring configurations and/or the like transducer assemblies may be configured for transmission of acoustic signals with different orientations of transducer elements and/or transducer assemblies may be configured for reception of acoustic signals with different orientations of transducer elements.

P (pressure) and T (torsional) waves can be launched into the pipe string (not shown) via the various embodiments described herein using alternative synchronization patterns. Where transducer assemblies 118 are evenly circumferentially distributed about central axis 2, such transducer assemblies 118 may provide circular points of pressure to launch pressure waves into the body of sub 102 for propagation of energy through the walls of sub 102 and through the walls of the pipe stands that form a drill string. The ratio of masses ahead and behind the launch points may allow tuning of the frequency response for allow communications to propagate through the walls of the pipe stands that make up the drill string.

The transducer-holding assembly and sub 102, when compressed, may provide a detuned mechanical lateral resonance in the range of approximately 1 KHz to 10 KHz. Mechanical resonance is provided by the elasticity and mass of the material(s) used to fabricate sub 102 and the transducer-holding assembly. In some particular and non-limiting embodiments, sub 102 and the transducer-holding assembly are fabricated from non-magnetized steel and may be machined using a CNC 4-axes live mill.

Embodiments of the invention provide a mechanical mounting apparatus for operatively connecting transducers to pipes. Embodiments of the invention are capable of servicing multiple markets for which transducers in pipe are desired. Embodiments of the invention facilitate:

- Mounting multiple transducers (e.g. piezoelectric actuators) inside of a pipe, without unduly impact flow of material in or through the pipe.

Tensioning multiple transducers (e.g. piezoelectric actuators) to provide appropriate signaling through the pipe.

Mounting electronics and batteries used to actuate the transducers (e.g. piezoelectric actuators) inside a pipe.

Providing electrical interconnection between the transducers (e.g. piezoelectric actuators) and the electronics.

Mounting on an assembly of pipes drilling into the earth or travelling through other media.

Embodiments of the invention may be used for a variety of applications, including (by way of non-limiting example) to provide downhole data communications in the oil and gas industry where pipes are used to transport oil and gas. Current downhole communication systems rely on mud pulse telemetry or electromagnetic communication, each of which has inherent problems. It is expected that various embodiments of the invention (adapted for downhole communication systems in the oil and gas industry) could increase data communications rates by several orders of magnitude.

As energy resources become more precious, emerging technologies like geothermal energy will become more viable. Embodiments of the invention, adapted for geothermal exploration and drilling, could increase drilling efficiency and accuracy to a point where such energy sources become a mainstream energy provider. Embodiments of the invention could also be adapted for reservoir management, offshore drilling, undersea cable management and/or the like.

While a number of exemplary aspects and embodiments are discussed herein, those of skill in the art will recognize certain modifications, permutations, additions and sub-combinations thereof. For example:

The description above suggests that the pipes with which the apparatus and methods of the invention are used are drilled into earth. This is not necessary. In some embodiments, the pipes may be provided in other media.

The description above suggests that piezoelectric actuators are used to create acoustic (e.g. pressure) waves in pipe. In other embodiments, actuators of other types (e.g. hydraulic actuators, electro-mechanical actuators, magnetostrictive actuators and/or the like) could be used to effect such acoustic waves.

A generalized capability is envisioned to use alternative forms of generation using piezoelectric actuators as well as alternate forms of pressure generation. In the embodiment described above, piezoelectric actuators expand and contract along the axial direction of the pipe and are used to stretch and contract the pipe axially. In some embodiments, piezoelectric actuators could be configured to expand and contract in radial directions to cause the pipe to expand and contract radially. In some embodiments, a series of such radially oriented actuators, spaced axially apart from one another, could be used to create transverse pressure waves that travel along the axial dimension of the pipe.

Furthermore, although the terms "sub-pipe" or "sub" generally refers to the concept of any small component of the drill strings (e.g. pipes shorter than the drill stands). It should be understood such words are not limited to the concept of pipes shorter than the drill stands. In some embodiments, the sub-pipe may substantially match the length of the pipe stands used in forming the drill strings. In some particular and non-limiting embodiments, the sub-pipe has a length between 30 to 45 feet (about 9 m to 14 m). In some embodiments, the length of the sub may be longer than the pipe stands forming the drill string.

In the embodiments described above, transducer elements 516 in transducer assemblies 118 are apertured and have generally annular cross-sections with generally circular outer circumferences. In other embodiments, transducer elements 516 may have other cross-sectional shapes. For example, transducer elements 516 may be apertured, but may have perimeter shapes other than circular.

It is therefore intended that the following appended claims and claims hereafter introduced are interpreted to include all such modifications, permutations, additions and sub-combinations as are within their true spirit and scope.

What is claimed is:

1. An apparatus for mounting one or more transducers to a rotatable drilling pipe stand comprising:

a sub-pipe comprising a bore-defining surface defining an axially oriented bore therethrough, a connector at a first axial end, and a connector at a second axial end, at least one of the connectors connectable to the rotatable drilling pipe string for rotation of the sub-pipe, while drilling, and for corresponding transmission of torque through the drilling pipe string and the sub-pipe to a drill bit connected to the drilling pipe string; and a transducer-holding assembly comprising one or more transducers, the transducer-holding assembly operably insertable into the bore of the sub-pipe from one of the first and second axial ends and mountable in the bore of the sub-pipe to provide intimate contact which facilitates acoustic communication between the one or more transducers and the sub-pipe;

wherein the bore-defining surface of the sub-pipe comprises an arrest shaped to reduce a cross-sectional area of the bore in a vicinity of the arrest relative to at least one region of the bore adjacent the arrest;

the transducer-holding assembly is mounted within the bore of the sub-pipe and wherein the apparatus comprises a tension collar located in the bore on a first axial side of the transducer-holding assembly to bear against a first axial end of the transducer-holding assembly; and the tension collar is connected to the bore-defining surface to bear against the first axial end of the transducer-holding assembly and wherein the connection of the tension collar to the bore-defining surface comprises an adjustable connection wherein the tension collar is axially moveable relative to the sub-pipe when connected thereto for adjusting a force with which the tension collar bears against the first axial end of the transducer-holding assembly.

2. An apparatus according to claim 1 wherein the sub-pipe is monolithically fabricated and the transducer-holding assembly is inserted into the bore of the sub-pipe from one of the first and second axial ends and mounted within the bore of the sub-pipe to provide the intimate contact which facilitates acoustic communication between the one or more transducers and the sub-pipe.

3. An apparatus according to claim 1 wherein the transducer-holding assembly defines at least a portion of an axially-extending channel, the channel permitting axial drilling fluid flow therethrough.

4. An apparatus according to claim 1 wherein the intimate contact which facilitates acoustic communication between the one or more transducers and the sub-pipe comprises contact with the bore-defining surface at at least two spaced apart locations and wherein the one or more transducers are located between the two spaced apart locations.

5. An apparatus according to claim 1 wherein the tension collar is threadably connected to the bore-defining surface.

6. An apparatus according to claim 1, wherein the transducer-holding assembly is mounted within the bore of the sub-pipe and wherein the transducer-holding assembly comprises a tension collar portion.

7. An apparatus according to claim 6 wherein the tension collar portion is connected to the bore-defining surface and wherein the connection of the tension collar portion to the bore-defining surface comprises an adjustable connection wherein the transducer-holder assembly is axially moveable relative to the sub-pipe when connected thereto.

8. An apparatus according to claim 7 wherein the tension collar portion is threadably connected to the bore-defining surface.

9. An apparatus according to claim 1 comprising a feed-through located in the bore on a second axial side of the transducer-holding assembly to bear against a second axial end of the transducer-holding assembly and against the arrest and wherein the tension collar is adjustably connected to the bore-defining surface for adjustable axial movement relative to the sub-pipe and corresponding adjustment of a force with which the tension collar bears against the first axial end of the transducer-holding assembly.

10. An apparatus according to claim 1 wherein the arrest comprises a lipped arrest, the lipped arrest having an annular bearing surface which faces, at least partially, the first axial end of the sub-pipe.

11. An apparatus for mounting one or more transducers to a rotatable drilling pipe stand comprising:

a sub-pipe comprising a bore-defining surface defining an axially oriented bore therethrough, a connector at a first axial end, and a connector at a second axial end, at least one of the connectors connectable to the rotatable drilling pipe string for rotation of the sub-pipe, while drilling, and for corresponding transmission of torque through the drilling pipe string and the sub-pipe to a drill bit connected to the drilling pipe string;

a transducer-holding assembly comprising one or more transducers, the transducer-holding assembly operably insertable into the bore of the sub-pipe from one of the first and second axial ends and mountable in the bore of the sub-pipe to provide intimate contact which facilitates acoustic communication between the one or more transducers and the sub-pipe; and a feed-through located in the bore on a second axial side of the transducer-holding assembly to bear against a second axial end of the transducer-holding assembly and to bear against the arrest;

wherein the bore-defining surface of the sub-pipe comprises an arrest shaped to reduce a cross-sectional area of the bore in a vicinity of the arrest relative to at least one region of the bore adjacent the arrest; and the feed-through comprises a sub-pipe engaging portion shaped to bear against the arrest and a connector portion for connection to an electronics housing.

12. An apparatus according to claim 11 wherein the transducer-holding assembly is mounted within the bore of the sub-pipe and wherein the apparatus comprises a tension collar located in the bore on a first axial side of the transducer-holding assembly to bear against a first axial end of the transducer-holding assembly.

13. An apparatus according to claim 11 wherein the connector portion is located in a radial center of the bore and the feed-through comprises one or more arms that extend between the connector portion and the sub-pipe engaging portion.

14. An apparatus for mounting one or more transducers to a rotatable drilling pipe stand comprising:

a sub-pipe comprising a bore-defining surface defining an axially oriented bore therethrough, a connector at a first axial end, and a connector at a second axial end, at least one of the connectors connectable to the rotatable drilling pipe string for rotation of the sub-pipe, while drilling, and for corresponding transmission of torque through the drilling pipe string and the sub-pipe to a drill bit connected to the drilling pipe string;

a transducer-holding assembly comprising one or more transducers, the transducer-holding assembly operably insertable into the bore of the sub-pipe from one of the first and second axial ends and mountable in the bore of the sub-pipe to provide intimate contact which facilitates acoustic communication between the one or more transducers and the sub-pipe; and a feed-through located in the bore on a second axial side of the transducer-holding assembly to bear against a second axial end of the transducer-holding assembly and to bear against the arrest;

wherein the bore-defining surface of the sub-pipe comprises an arrest shaped to reduce a cross-sectional area of the bore in a vicinity of the arrest relative to at least one region of the bore adjacent the arrest; and the feed-through comprises a radially outward surface which, together with the bore-defining surface of the sub-pipe define at least a portion of an electronics housing for housing electronics.

15. An apparatus for mounting one or more transducers to a rotatable drilling pipe stand comprising:

a sub-pipe comprising a bore-defining surface defining an axially oriented bore therethrough, a connector at a first axial end, and a connector at a second axial end, at least one of the connectors connectable to the rotatable drilling pipe string for rotation of the sub-pipe, while drilling, and for corresponding transmission of torque through the drilling pipe string and the sub-pipe to a drill bit connected to the drilling pipe string; and a transducer-holding assembly comprising one or more transducers, the transducer-holding assembly operably insertable into the bore of the sub-pipe from one of the first and second axial ends and mountable in the bore of the sub-pipe to provide intimate contact which facilitates acoustic communication between the one or more transducers and the sub-pipe;

wherein the bore-defining surface of the sub-pipe comprises an arrest shaped to reduce a cross-sectional area of the bore in a vicinity of the arrest relative to at least one region of the bore adjacent the arrest; and the transducer-holding assembly comprises a feed-through portion, the feed-through portion is located at the second axial end of the transducer-holding assembly to bear against the arrest and the feed-through portion comprises a sub-pipe engaging portion shaped to bear against the arrest and a connector portion for connection to an electronics housing.

16. An apparatus for mounting one or more transducers to a rotatable drilling pipe stand comprising:

a sub-pipe comprising a bore-defining surface defining an axially oriented bore therethrough, a connector at a first axial end, and a connector at a second axial end, at least one of the connectors connectable to the rotatable drilling pipe string for rotation of the sub-pipe, while drilling, and for corresponding transmission of torque through the drilling pipe string and the sub-pipe to a drill bit connected to the drilling pipe string; and a transducer-holding assembly comprising one or more transducers, the transducer-holding assembly operably insertable into the bore of the sub-pipe from one of the first and second axial ends and mountable in the bore of the sub-pipe to provide intimate contact which facilitates acoustic communication between the one or more transducers and the sub-pipe;

wherein the bore-defining surface of the sub-pipe comprises an arrest shaped to reduce a cross-sectional area of the bore in a vicinity of the arrest relative to at least one region of the bore adjacent the arrest; and the arrest comprises a threaded arrest, the threaded arrest comprising a helical bearing surface which faces, at least partially, the first axial end of the sub-pipe.

17. An apparatus for mounting one or more transducers to a rotatable drilling pipe stand comprising:

a sub-pipe comprising a bore-defining surface defining an axially oriented bore therethrough, a connector at a first axial end, and a connector at a second axial end, at least one of the connectors connectable to the rotatable drilling pipe string for rotation of the sub-pipe, while drilling, and for corresponding transmission of torque through the drilling pipe string and the sub-pipe to a drill bit connected to the drilling pipe string; and a transducer-holding assembly comprising one or more transducers, the transducer-holding assembly operably insertable into the bore of the sub-pipe from one of the first and second axial ends and mountable in the bore of the sub-pipe to provide intimate contact which facilitates acoustic communication between the one or more transducers and the sub-pipe;

wherein the transducer-holding assembly comprises:

a transducer holder; and one or more transducer assemblies, each transducer assembly comprising a plurality of transducers;

the transducer holder comprising one or more mounting features for holding one or more transducer assemblies, wherein the one or more mounting features comprise:

a first flange comprising a first flange surface that faces generally toward the second axial end of the sub-pipe for contacting first axial ends of the one or more transducer assemblies; and a second flange axially spaced apart from the first flange, the second flange comprising a second flange surface that faces generally toward the first axial end of the sub-pipe for contacting the second axial ends of the one or more transducer assemblies;

wherein the contact between the first and second flange surfaces and the first and second axial ends of one or more transducer assemblies holds the transducer assemblies on the transducer holder.

18. An apparatus according to claim 17 wherein the bore-defining surface of the sub-pipe comprises an arrest shaped to reduce a cross-sectional area of the bore in a vicinity of the arrest relative to at least one region of the bore adjacent the arrest.

19. An apparatus according to claim 18 comprising a feed-through located in the bore on a second axial side of the transducer-holding assembly to bear against a second axial end of the transducer-holding assembly and to bear against the arrest.

20. An apparatus according to claim 17 wherein the first and second flange surfaces extend in generally radial directions.

21. An apparatus according to claim 17 wherein the transducer holder comprises a radially outward facing surface that extends axially between the first and second flange surfaces and wherein the radially outward facing surface comprises one or more radially outwardly opening and axially extending concavities, each concavity shaped for accommodating a portion of a corresponding transducer assembly.

22. An apparatus according to claim 17 wherein the transducer holder comprises a radially inward facing surface that extends axially between the first and second flange surfaces and wherein the radially inward facing surface comprises one or more radially inwardly opening and axially extending concavities, each concavity shaped for accommodating a portion of a corresponding transducer assembly.

* * * * *